US008577274B2

(12) United States Patent
Tawada et al.

(10) Patent No.: US 8,577,274 B2
(45) Date of Patent: Nov. 5, 2013

(54) IMAGE FORMING APPARATUS INCLUDING A LUBRICANT APPLYING DEVICE CONFIGURED TO APPLY LUBRICANT TO AN IMAGE CARRIER

(75) Inventors: Takaaki Tawada, Kanagawa (JP); Hiroshi Saitoh, Tokyo (JP); Kaoru Yoshino, Tokyo (JP); Akira Fujimori, Kanagawa (JP); Kensuke Sasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 271 days.

(21) Appl. No.: 12/929,675

(22) Filed: Feb. 8, 2011

(65) Prior Publication Data

US 2011/0206431 A1 Aug. 25, 2011

(30) Foreign Application Priority Data

Feb. 22, 2010 (JP) ..... 2010-035871
Oct. 15, 2010 (JP) ..... 2010-232696

(51) Int. Cl.
*G03G 21/00* (2006.01)

(52) U.S. Cl.
USPC ..... 399/346

(58) Field of Classification Search
USPC ..... 399/346–347
See application file for complete search history.

(56) References Cited

U.S. PATENT DOCUMENTS

| | | | | |
|---|---|---|---|---|
| 7,630,679 | B2 | 12/2009 | Tawada | |
| 2006/0285897 | A1* | 12/2006 | Sugiura et al. | 399/346 |
| 2007/0059067 | A1* | 3/2007 | Tanaka et al. | 399/346 |
| 2007/0183824 | A1* | 8/2007 | Suda et al. | 399/346 |
| 2008/0031666 | A1 | 2/2008 | Tawada | |
| 2008/0069598 | A1* | 3/2008 | Murakami et al. | 399/265 |
| 2009/0060600 | A1 | 3/2009 | Ninomiya et al. | |
| 2009/0103944 | A1 | 4/2009 | Shintani et al. | |
| 2009/0142574 | A1 | 6/2009 | Muraishi et al. | |
| 2009/0185842 | A1 | 7/2009 | Hatori et al. | |
| 2009/0252510 | A1 | 10/2009 | Shintani et al. | |
| 2010/0215417 | A1 | 8/2010 | Fujimori | |
| 2011/0081177 | A1* | 4/2011 | Nishida | 399/346 |

FOREIGN PATENT DOCUMENTS

| | | | |
|---|---|---|---|
| JP | 03260683 | A | 11/1991 |
| JP | 11038855 | A * | 2/1999 |
| JP | 2006251751 | A | 9/2006 |

(Continued)

OTHER PUBLICATIONS

A machine translation of Tawada, i.e. JP-2009-271159.*

*Primary Examiner* — G. M. Hyder
(74) *Attorney, Agent, or Firm* — Harness, Dickey & Pierce, PLC

(57) ABSTRACT

An image forming apparatus includes an image carrier, a cleaning device having a cleaning member that comes into contact with a surface of the image carrier, and a lubricant applying device provided on the downstream side of the cleaning member. The lubricant applying device includes a solid lubricant, a lubricant supply roller, and a trailing type lubricant smoothing blade that is provided on the downstream side of the lubricant supply roller, and comes into belly contact with the surface of the image carrier. After image carrier is stopped, constantly or under a predetermined condition, the surface of the image carrier is moved in a direction opposite to an image forming direction. The opposite movement distance is equal to or more than the shortest distance between a contact point between the lubricant supply roller and the image carrier and a contact point between the lubricant smoothing blade and the image carrier.

18 Claims, 13 Drawing Sheets

(56) References Cited

FOREIGN PATENT DOCUMENTS

| | | | |
|---|---|---|---|
| JP | 2007127811 A | | 5/2007 |
| JP | 2007127811 A | * | 5/2007 |
| JP | 2007241114 A | | 9/2007 |
| JP | 2009116213 A | | 5/2009 |
| JP | 2009271159 A | | 11/2009 |

* cited by examiner

IMAGE FORMING APPARATUS INCLUDING A LUBRICANT APPLYING DEVICE CONFIGURED TO APPLY LUBRICANT TO AN IMAGE CARRIER

CROSS-REFERENCE TO RELATED APPLICATIONS

The present application claims priority to and incorporates by reference the entire contents of Japanese Patent Application No. 2010-035871 filed in Japan on Feb. 22, 2010 and Japanese Patent Application No. 2010-232696 filed in Japan on Oct. 15, 2010.

BACKGROUND OF THE INVENTION

1. Field of the Invention

The present invention relates to an image forming apparatus that applies a lubricant onto the surface of an image carrier to form a lubricant thin film.

2. Description of the Related Art

According to an image forming process in an electrophotographic image forming apparatus, an electrostatic latent image is formed on a photosensitive element, which is an image carrier, using a photoconductive phenomenon and colored toner fine particles are attached to the electrostatic latent image using electrostatic force to visualize the electrostatic latent image. In general, the electrophotographic image forming apparatus includes a lubricant applying device that applies a lubricant onto the surface of the photosensitive element, which is a main member.

In recent years, the processing speed and image quality of color copiers and printers have been improved and a four-drum tandem image forming apparatus has been generally used as the electrophotographic image forming apparatus. In addition, with the rise of environmental consciousness, it is increasingly important to recycle materials, improve reliability, and increase a life span. In addition, the awareness of the amount of ozone generated and the amount of dust generated increases considering an office environment.

Therefore, in the image forming apparatus, in many cases, a charging roller that generates a small amount of ozone is used as a charging member. In some cases, a charging roller that faces a photosensitive element with a small gap therebetween is used in order to increase a life span. In many cases, in order to meet a demand for high-quality image, an AC voltage that enables a sufficient amount of charging current to flow to the charging roller and enables stabilizing a charging potential is applied to the charging roller. When an AC voltage is applied to the charging roller, the surface of the photosensitive element is damaged by a charging current. Therefore, in order to protect the surface of the photosensitive element, a lubricant is applied onto the photosensitive element.

When the lubricant is applied, the friction coefficient of the surface of the photosensitive element is reduced and the movement of the edge of a cleaning blade is stabilized. Therefore, it is possible to improve a cleaning performance. As a lubricant applying mechanism, in general, a rod-shaped lubricant is pressed against a brush roller by, for example, a spring, and the brush roller scrapes away the lubricant and applies the lubricant onto the surface of the photosensitive element. Then, a flexible blade is used to smooth the lubricant into a thin film. In addition, in many cases, a lubricant applying device is provided on the downstream side of a photosensitive element cleaning device in order to stabilize the application of the lubricant. The lubricant applying device provided on the downstream side of the photosensitive element cleaning device includes a flexible blade for applying a lubricant, separately from the photosensitive element cleaning device.

For example, Japanese Patent Application Laid-open No. 2009-116213 discloses a lubricant applying device including a lubricant applying member that applies a lubricant onto the surface of a photosensitive element and a lubricant smoothing blade that comes into contact with the surface of the photosensitive element in the counter direction, and presses and spreads the lubricant on the surface of the photosensitive element. In the lubricant applying device, the angle of a ridge that is between a lubricant smoothing blade lower surface, which faces the surface of the photosensitive element on the downstream side of a contact portion between the surface of the photosensitive element and the lubricant smoothing blade along a direction in which the surface of the photosensitive element is moved, and the lubricant smoothing blade leading end surface, which faces the surface of the photosensitive element on the upstream side of the contact portion is 90° or about 90°. The angle between a tangent line to the surface of the photosensitive element in the contact portion and the leading end surface is equal to or more than 85°.

Japanese Patent Application Laid-open No. 2006-251751 discloses a lubricant applying device in which a cleaning blade comes into contact with the surface of a photosensitive element in the counter direction, a lubricant smoothing blade comes into contact with the surface of the photosensitive element in the trailing direction, toner remaining on the surface of the photosensitive element is removed by the cleaning blade, a lubricant is applied onto the surface of the cleaned photosensitive element by a brush roller, and the lubricant smoothing blade smoothes the lubricant into a thin film on the downstream side.

Japanese Patent Application Laid-open No. 2007-127811 discloses an image forming apparatus that includes: a cleaning device including a cleaning blade which comes into contact with an image carrier by a counter method to remove toner remaining on the surface of an image carrier after transfer, a lubricant applying device which is provided with a lubricant applying member for applying the lubricant onto the surface of the image carrier, and a lubricant smoothing blade which comes into contact with the image carrier by a trailing method and spreads the lubricant applied onto the surface of the image carrier to form a thin layer, which are provided in this order from the upstream side of the image carrier in the rotational direction. The image forming apparatus further includes: a driving unit that rotates the image carrier in a direction opposite to the regular rotational direction after an image is formed; and a sheet-like antipollution member that comes into contact with the image carrier on the downstream side of the lubricant smoothing blade.

Japanese Patent Application Laid-open No. 2007-241114 discloses a lubricant applying device including a lubricant that is held on or in the vicinity of the surface of an image carrier for carrying an image and is applied onto the surface of the image carrier and an applying blade that applies the lubricant onto the surface of the image carrier. In the lubricant applying device, the lubricant is made of a lubricant material including fine particles with a volume average particle diameter of 0.1 μm to 10 μm, and the applying blade is supported so as to come into contact with the image carrier 1 at an angle (β) of 95° to 170° in the trailing direction with respect to the rotational direction of the image carrier 1.

In the lubricant applying device and the image forming apparatus, however, the lubricant smoothing blade slides on the photosensitive element while the edge of the lubricant smoothing blade is in contact with the photosensitive element. Therefore, the edge of the lubricant smoothing blade contacting the photosensitive element is worn out over time, and a performance for applying the lubricant onto the photosensitive element deteriorates. Then, the lubricant leaks out and the surface of the charging roller is contaminated by the lubricant. As a result, the electric resistance of the surface of the charging roller increases and a color streak image is formed.

In addition, the amount of lubricant applied onto the photosensitive element is insufficient and the protection of the photosensitive element is insufficient. The surface of the photosensitive element is filmed with toner and an image with uneven density is formed.

In the above-mentioned structure in which the lubricant smoothing blade comes into belly contact with the photosensitive element by the trailing method, it is possible to reduce the abrasion of the lubricant smoothing blade and improve the durability of the cleaning unit, as compared to a general edge contact structure. However, the above-mentioned structure has the following problems: a foreign material is likely to be caught in the lubricant smoothing blade, which causes the damage of the image carrier, the partial leakage of the toner and lubricant, the contamination of other process components, such as the partial contamination of the charging roller, and the formation of abnormal image due to the partial leakage of toner and lubricant.

SUMMARY OF THE INVENTION

It is an object of the present invention to at least partially solve the problems in the conventional technology.

According to an aspect of the present invention, there is provided an image forming apparatus including: an image carrier; a cleaning device having a cleaning member that comes into contact with a surface of the image carrier; and a lubricant applying device provided on the downstream side of the cleaning member in a direction in which the surface of the image carrier is moved, wherein the lubricant applying device includes: a solid lubricant; a lubricant supply roller that supplies the lubricant to the image carrier; and a lubricant smoothing blade that is a trailing type, is provided on the downstream side of the lubricant supply roller in the movement direction of the surface of the image carrier, and comes into belly contact with the surface of the image carrier, after the image carrier is stopped, constantly or under a predetermined condition, the surface of the image carrier is moved in a direction opposite to an image forming direction, and the movement distance of the surface of the image carrier in the opposite direction is equal to or more than the shortest distance between a contact point between the lubricant supply roller and the surface of the image carrier and a contact point between the lubricant smoothing blade and the surface of the image carrier.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 17A shows a shape coefficient SF-1 and FIG. 17B shows a shape coefficient SF-2.

DETAILED DESCRIPTION OF THE PREFERRED EMBODIMENTS

Hereinafter, exemplary embodiments of the invention will be described with reference to the accompanying drawings. It is obvious for those skilled in the art to change and modify the invention within the scope of the claims to obtain other embodiments, and the change and modification in the invention are also included within the scope of the claims. The following exemplary embodiments of the invention are illustrative, but do not limit the scope of the claims.

Exemplary embodiments of the invention will be described with reference to the drawings.

Figure 1:
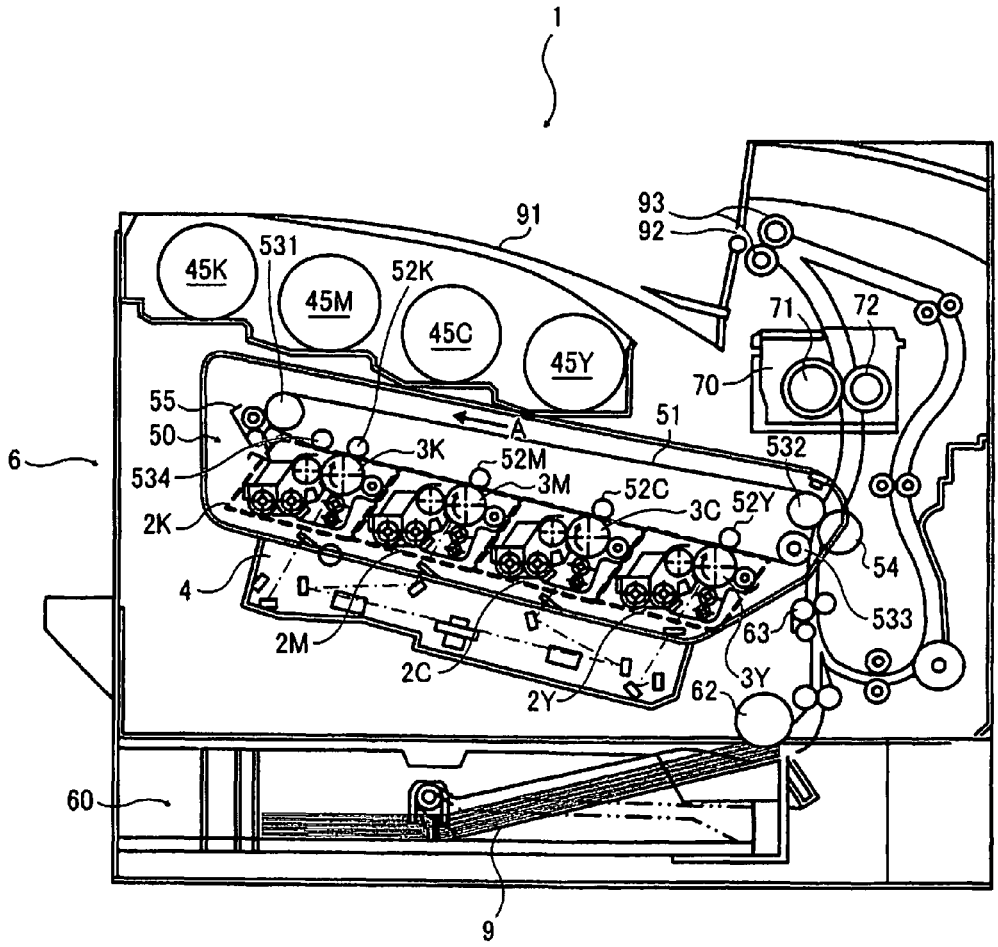
FIG. 1 is a diagram illustrating the structure of an image forming apparatus according to the invention.

FIG. 1 is a diagram illustrating the structure of an image forming apparatus according to an embodiment of the invention.

In this embodiment, an image forming apparatus 1 includes plural photosensitive elements 3K, 3M, 3C, and 3Y, but the invention is not limited to the image forming apparatus 1 according to this embodiment. In this embodiment, control is performed on the basis of the amount of toner of each of the photosensitive elements 3K, 3M, 3C, and 3Y. All of process cartridges 2 are the same type and the general structure thereof is described.

The image forming apparatus 1 includes an image forming unit 6 having, for example, the photosensitive elements 3, which are image carriers for forming toner images, and a feeding device 60 that is provided below the image forming unit 6. In addition, the image forming apparatus 1 includes a discharge tray 91 which is provided above the image forming unit and on which a recording member 9 having an image formed thereon is loaded.

In the image forming apparatus 1, the image forming unit 6 is arranged at the center. Substantially at the center of the image forming unit 6, four process cartridges, serving as image forming units corresponding to yellow (Y), magenta (M), cyan (C), and black (K) toners, are arranged in tandem along a transfer device 50. The transfer device 50 includes an intermediate transfer belt 51 which is an intermediate transfer body made of a heat-resistant material, such as polyimide or polyamide, is wound around four rollers 531, 532, 533, and 534 to be supported, and is rotated in the direction of an arrow A in FIG. 1. The intermediate transfer belt 51 is an endless belt whose resistance is adjusted to an intermediate value.

An exposure device 4 that emits light to the surface of each of the charged photosensitive elements 3 on the basis of the image data of each color to form a latent image is provided below the four process cartridges. Primary transfer rollers 52, which are primary transfer devices that primarily transfer the toner image formed on each photosensitive element 3 to the intermediate transfer belt 51, are provided so as to face each photosensitive element 3 with the intermediate transfer belt 51 interposed therebetween. Each of the primary transfer rollers 52 is connected to a power supply (not shown) and is supplied with a predetermined voltage.

A secondary transfer roller 54, which is a secondary transfer device, comes into pressure contact with a surface of the intermediate transfer belt 51 opposite to the surface supported by the supporting roller 532. The secondary transfer roller 54 is connected to the power supply (not shown) and is supplied with a predetermined voltage. A contact portion between the secondary transfer roller 54 and the intermediate transfer belt 51 is a secondary transfer portion where the toner image on the intermediate transfer belt 51 is transferred to the recording member 9.

An intermediate transfer belt cleaning device 55 that cleans the surface of the intermediate transfer belt 51 after a secondary transfer operation is provided outside a portion of the intermediate transfer belt 51 supported by the supporting roller 531.

A fixing device 70 that semipermanently fixes the toner image on the recording member 9 to the recording member 9 is provided above the secondary transfer portion. The fixing device 70 includes a fixing roller 71 and a pressure roller 72 that faces the fixing roller 71, comes into pressure contact with the fixing roller 71, and has a halogen heater provided therein. An endless fixing belt (not shown) that is wound around a heating roller having a halogen heater provided therein and a fixing roller may be used instead of the fixing roller 71.

The feeding device 60 which has the recording member 9 loaded thereon and feeds the recording member 9 to the secondary transfer portion is provided at a lower part of the image forming apparatus.

Figure 2:
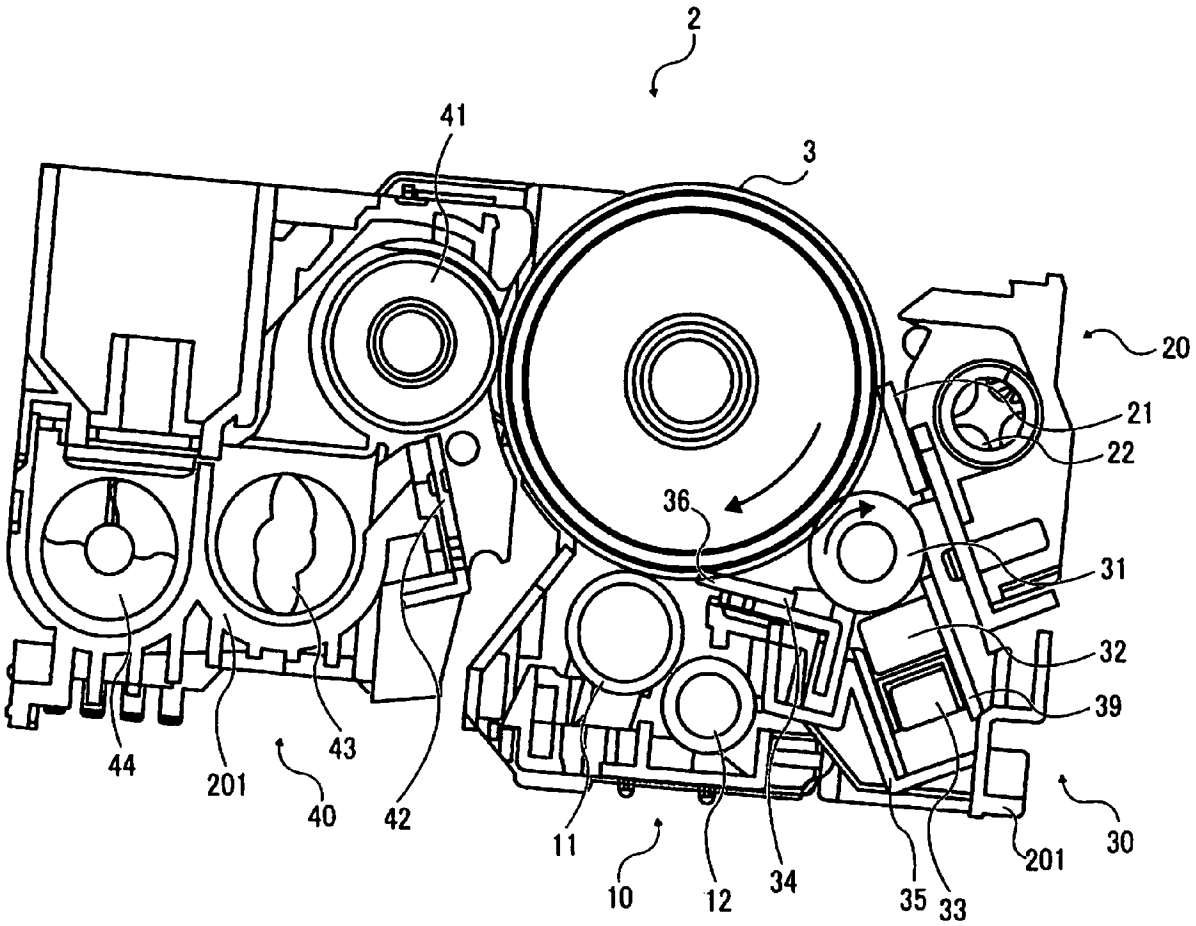
FIG. 2 is an enlarged view illustrating the structure of one of four process cartridges.

FIG. 2 is an enlarged view schematically illustrating the structure of one of the four process cartridges. Since the four process cartridges have the same structure, the illustration of Y, M, C, and K for discriminating colors is omitted in FIG. 2. Each of the process cartridges includes the photosensitive element 3. A charging device 10 that charges the surface of the photosensitive element 3, a developing device 40 that develops the latent image formed on the surface of the photosensitive element 3 into a toner image with each color toner, a lubricant applying device 30 that applies a lubricant 32 onto the surface of the photosensitive element 3, and a cleaning device 20 that cleans the surface of the photosensitive element 3 after the toner image is transferred are provided around each photosensitive element 3.

The components shown in FIG. 2 may be individually incorporated into an image forming apparatus body. However, one or more of the photosensitive element 3, the charging device 10, the developing device 40, the cleaning device 20, and the lubricant applying device 30 are integrally supported and are removably provided in the image forming apparatus 1. In this embodiment, since the image forming apparatus includes at least the photosensitive element 3 and the lubricant applying device 30, a high setting performance, a high maintenance performance, and high positional accuracy are obtained.

Figure 3:
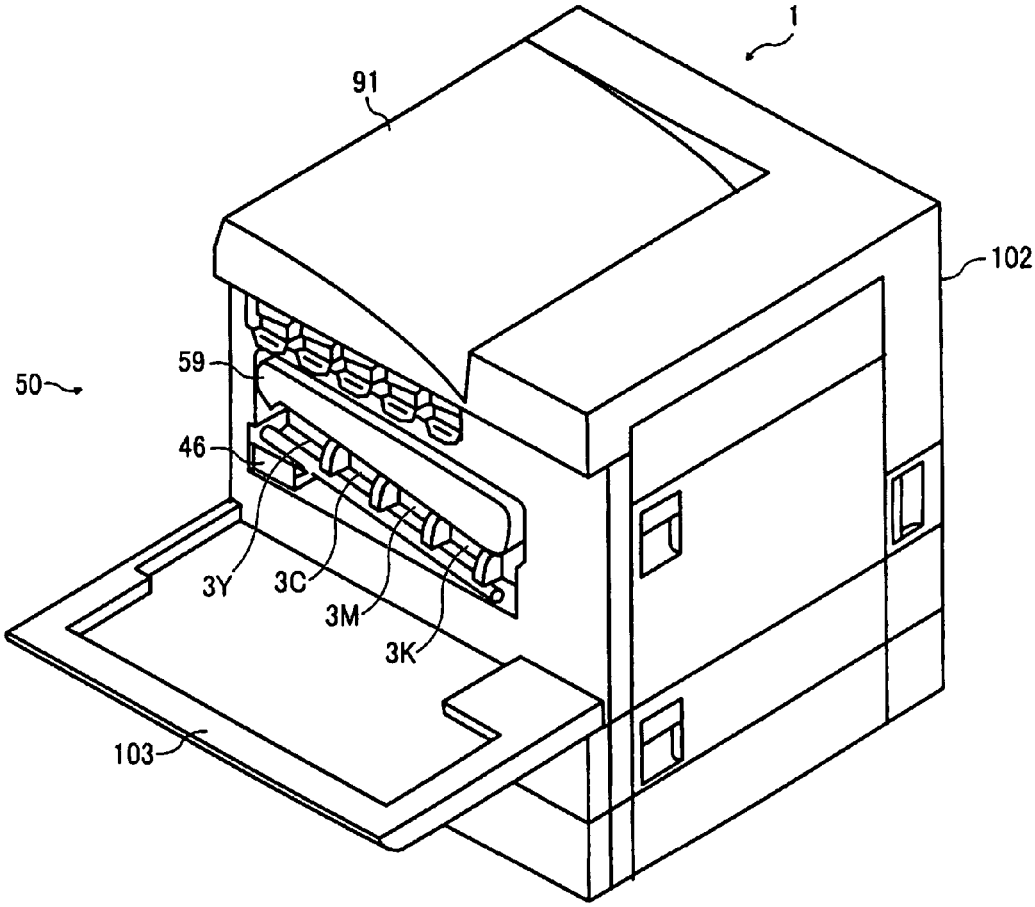
FIG. 3 is a diagram illustrating the arrangement of the process cartridges of the image forming apparatus according to the invention.

FIG. 3 is a diagram illustrating the arrangement of the process cartridges in the image forming apparatus according to the embodiment of the invention.

FIG. 3 shows the opened state of a front cover 103 provided in a main housing 102 of the image forming apparatus 1 according to the embodiment of the invention. When the front cover 103 is opened, the process cartridge 2 and a waste toner collecting container 46 appear, and it is possible to perform a process of replacing the process cartridge 2, the intermediate transfer belt 51, and the waste toner collecting container 46 or other maintenance processes. The intermediate transfer belt 51 and the supporting rollers 531, 532, 533, and 534 are accommodated as a unit in a belt case 50*a*.

Process cartridges 2Y, 2M, 2C, and 2K are provided in parallel to each other below the unified portion of the transfer device 50.

As the photosensitive element 3, there is a photosensitive element 3 using a metal material such as amorphous silicon and selenium, or a photosensitive'element 3 using an organic photosensitive material. Herein, the photosensitive element 3 will be explained with the organic photosensitive element. The photosensitive element 3 has on a conductive supporting member, a filler-dispersed resin layer, a photosensitive layer having a charge generating layer and a charge transport layer, and a protective layer in which fillers are dispersed on the surface.

Although the photosensitive layer may be a photosensitive layer composed of a single layer including a charge generating material and a charge transport material, a laminated type that is composed of a charge generating layer and a charge transport layer is excellent in sensitivity and durability.

The charge generating layer is formed by dispersing a pigment that has charge generating ability along with a binder resin if necessary in a suitable solvent using a ball mill, an attritor, a sand mill, an ultrasonic wave and the like, applying it onto a conductive supporting member, and drying it. Examples of the binder resin include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinyl carbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulose-based resin, casein, polyvinyl alcohol, polyvinyl pyrolidone, etc. The amount of the binder resin is suitably 0 to 500 mass parts, preferably 10 to 300 mass parts with respect to 100 mass parts of the charge generating material.

Furthermore, the charge transport layer may be formed by dissolving or dispersing a charge transport material and a binder resin in a suitable solvent, applying it onto a charge generating layer, and drying it. As the charge transport material, there are hole transport materials and electron transport materials. Examples of the binder resin include thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin and alkyd resin.

Furthermore, a protective layer may be provided on the photosensitive layer. By providing the protective layer whereby to improve durability, the photosensitive element 3 of the present invention may be usefully used, which has high sensitivity and no abnormal defect.

Examples of the material used in the protective layer include resins such as ABS resin, ACS resin, olefin-vinyl monomer copolymer, chlorinated polyether, allyl resin, phenol resin, polyacetal, polyamide, polyamide imide, polyacrylate, polyallyl sulfone, polybutylene, polybutylene terephthalate, polycarbonate, polyarylate, polyether sulfone, polyethylene, polyethylene terephthalate, polyimide, acrylic resin, polymethylpentene, polypropylene, polyvinylidene chloride and epoxy resin.

Among them, polycarbonate or polyacrylate may be most preferably used. In addition, fluoric resins such as polytetrafluoroethylene, silicone resins, and dispersions of inorganic fillers or organic fillers such as titanium oxide, tin oxide, potassium titanate and silica in these resins may be added to the protective layer for the purpose of improving abrasion resistance. A concentration of the filler in the protective layer varies on the kind of the filler used, and electrophotography processing conditions at which the photosensitive element 3 is used, but is suitably 5 mass % or more, preferably 10 mass % or more and 50 mass % or less, and preferably 10 mass % or more and 30 mass % or less, or so in the filler ratio with respect to the total solid content in the side of the most-superficial layer of the protective layer.

The charging device 10 is a discharge charger type, such as a corotron type in which thin metal wires made of, for example, tungsten or molybdenum or wires obtained by plating the thin metal wires with a metal material extend in an aluminum case or a scorotron type in which metal wires are provided in a grid in an aluminum case. In addition, there is a roller type in which a rotating roller contacts the photosensitive element or faces the photosensitive element with a small gap therebetween in a non-contact manner. The charging device 10 may be any one of the charging types.

Figure 4:
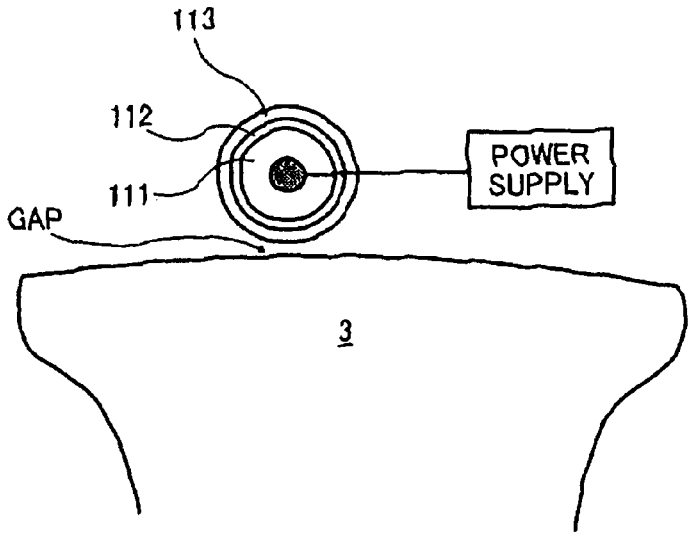
FIG. 4 is a diagram illustrating the structure of a charging roller.

FIG. 4 is a diagram illustrating the structure of the charging roller.

A charging roller 11 in which an elastic layer with an intermediate resistance value is coated on a conductive metal core is provided as a charging member. The charging roller 11 is connected to the power supply and is supplied with a predetermined voltage. The charging roller 11 is arranged so as to contact the photosensitive element 3. Even when the charging roller 11 contacts the photosensitive element 3, a portion of the circular cross-section of the charging roller 11 is close to the photosensitive element 3. A discharge occurs in a portion of the charging roller 11 close to the photosensitive element 3 and the photosensitive element 3 can be charged. In the embodiment of the invention, since a contact charging roller 12 that contacts and cleans the surface of the charging roller 11 is provided, the amount of ozone generated is reduced, which meets the current environmental needs.

The charging roller 11 includes a shaft portion 111, which is a metal core, a resistance adjusting layer 112 provided on the shaft portion 111, and a surface layer 113 provided on the resistance adjusting layer 112. The shaft portion 111 is made of a metal material with high rigidity and high conductivity, such as stainless steel or aluminum, or a conductive resin having a high rigidity of $1\times10^{3}\Omega\cdot$cm or less, preferably, $1\times10^{2}\Omega\cdot$cm or less with a diameter of 8 mm to 20 mm.

It is preferable that the resistance adjusting layer 112 have a volume resistivity of $1\times10^{5}\Omega\cdot$cm to $1\times10^{9}\Omega\cdot$cm and a thickness of about 1 mm to 2 mm.

It is preferable that the surface layer 113 have a volume resistivity of $1\times10^{6}\Omega\cdot$cm to $1\times10^{12}\Omega\cdot$cm and a thickness of about 10 μm. It is preferable that the volume resistivity of the surface layer be more than the electric resistivity of the resistance adjusting layer 112. In this embodiment, the charging roller 11 has a two-layer structure of the resistance adjusting layer 112 and the surface layer, but the invention is not limited to the structure. For example, the charging roller 11 may have a single-layer structure or a three-layer structure.

The resistance adjusting layer 112 is formed of a rein composition on the circumferential surface of the cored bar 31 by, for example, extrusion molding or injection molding. The JIS-D hardness of the resistance adjusting layer 112 is set to 45 degrees or more in order to prevent a variation in the gap between the photosensitive drum 3 and the charging roller 11 due to the deformation of the resistance adjusting layer 112 over time.

The thermoplastic resin used in the resistance adjusting layer 112 is not particularly limited as long as it can retain JIS-D hardness after shaping, but general-purpose resins such as polyethylene (PE), polypropylene (PP), poly(methyl methacrylate) (PMMA), polystyrene (PS) and a copolymer thereof (AS, ABS, etc.) are preferably used to facilitate the shaping process.

A conductive material, such as a polymer ion conductive agent, carbon black, or metal powder, may be used in order to adjust electric resistance.

The charging roller 11 is connected to the power supply and is supplied with a predetermined voltage. The voltage may be only a direct-current (DC) voltage. However, a voltage in which an alternating-current (AC) voltage is superimposed on a DC voltage is preferably used. When the AC voltage is applied, it is possible to uniformly charge the surface of the photosensitive drum 3. In this embodiment, an AC voltage is superimposed on a DC voltage. In the charging device 10 of a contact type in which the charging roller 11 contacts the photosensitive element 3 to charge the photosensitive element 3, the amount of discharge product is considerably less than that in the corona discharge type according to the related art, and a voltage applied is lower than that in the corona discharge type. Therefore, the cost of the power supply is reduced and it is easy to design electric insulation. Of course, a defect due to, for example, ozone or nitrogen oxide is also reduced.

The charging roller 11 is arranged with a small gap from the photosensitive drum 3. The small gap may be set by, for example, wrapping a spacer member having a constant thickness on non-image forming regions at both ends of the charging roller 11, thereby contacting the surface of the spacer member with the surface of the photosensitive drum 3.

The charging roller 11 may be provided with a small gap from the photosensitive element 3 so as not to contact the photosensitive element 3. In this case, a film is wrapped as a spacer at both ends of the charging roller 11. The spacer contacts a photosensitive surface of the photosensitive element 3 to form a constant small gap between the charging roller 11 and the image region of the photosensitive element 3. As a bias voltage, an AC-superimposed voltage is applied to generate a discharge in a small gap between the charging roller 11 and the photosensitive element 3, thereby charging the photosensitive element 3. In addition, the shaft portion 111 is pressed by, for example, a spring. In this way, the accuracy of maintaining the small gap is improved.

The spacer member may be formed integrally with the charging roller 11. In this case, at least the surface of a gap portion is made of an insulator. In this way, no discharge occurs in the gap portion, and a discharge product is not accumulated in the gap portion. Therefore, the fixation of toner to the gap portion due to the adhesion of the discharge product does not occur. As a result, the gap is not widened.

In the developing device 40, a developing roller 41 having a magnetic field generating unit (not shown) provided therein is provided so as to face the photosensitive element 3. Two stirring/transport screws 43 and 44, each serving as a mechanism that mixes toner supplied from a toner bottle (not shown) with the developer and pumps up the mixture to the developing roller 41 while stirring the mixture, are provided below the developing roller 41. The toner and the developer including magnetic carriers transported by the developing roller 41 are regulated to a predetermined thickness of a developer layer by a regulating member 42 and are carried on the developing roller 41. The developing roller 41 carries and transports the developer while moving in the same direction at a position facing the photosensitive element 3, thereby supplying the toner to a latent image surface of the photosensitive element 3.

As shown in FIG. 1, toner cartridges 45Y, 45C, 45M, and 45K each having unused color toner stored therein are removably provided above the photosensitive element 3. A necessary amount of toner is supplied to each developing device 40 by a toner transport unit (not shown), such as a mono pump or an air pump. For a black toner, which is largely consumed, a high-capacity black toner cartridge 45K may be used.

The cleaning device 20 includes a mechanism that contacts or separates a cleaning blade 21 with or from the photosensitive element 3. The cleaning device 20 may be arbitrarily contacted with or separated from the photosensitive element 3 by a control unit of the image forming apparatus body. The cleaning blade 21 is contacted with the photosensitive element 3 by a counter method to remove the toner remaining on the photosensitive element 3 and additives, such as talc, kaolin, and calcium carbonate, adhered on the photosensitive element 3 as a contaminant from the recording member 9, thereby cleaning the photosensitive element 3. For example, the removed toner is transported and stored in the waste toner container 46 by a waste toner collecting coil 22.

The lubricant applying device 30 includes a solid lubricant 32 that is stored in a fixed case, a lubricant supply roller 31 that contacts the solid lubricant 32 to scrape away the lubricant and applies the lubricant onto the photosensitive element 3, and a lubricant smoothing blade 34 that smoothes the lubricant applied by the lubricant supply roller 31. At least one lubricant supply roller 31 is provided. A plurality of lubricant supply rollers 31 may be provided. In this embodiment, one lubricant supply roller 31 is provided. The solid lubricant 32 has a rectangular parallelepiped shape and is urged to the lubricant supply roller 31 by a pressing spring 33. The solid lubricant 32 is scraped and worn away by the lubricant supply roller 31, and the thickness of the solid lubricant 32 is reduced over time. However, the solid lubricant 32 is pressed by the pressing spring 33 to constantly come into contact with the lubricant supply roller 31. The lubricant supply roller 31 applies the scraped lubricant to the surface of the photosensitive element 3 while being rotated. The amount of lubricant applied onto the photosensitive element 3 is adjusted by the number of rotations of the lubricant supply roller 31. As the number of rotations increases, the amount of lubricant scraped away from the solid lubricant 32 increases, and the amount of lubricant applied onto the photosensitive element 3 increases. On the contrary, as the number of rotations decreases, the amount of lubricant scraped away from the solid lubricant 32 decreases, and the amount of lubricant applied onto the photosensitive element 3 decreases. It is preferable that the rotational direction of the lubricant supply roller 31 be the same as the movement direction of the photosensitive element 3 shown in FIG. 2. However, the rotational direction of the lubricant supply roller 31 may be opposite to the movement direction of the photosensitive element 3.

The lubricant smoothing blade 34 serving as a lubricant smoothing unit comes into contact with the surface of the photosensitive element on the downstream side of the position where the lubricant is applied by the lubricant supply roller 31 in the movement direction. The lubricant smoothing blade 34 is made of rubber, which is an elastic body, and comes into contact with the surface of the photosensitive element in a trailing direction with respect to the movement direction of the photosensitive element 3. It is preferable that the thickness of brush fibers of the lubricant supply roller 31 that contacts the solid lubricant 32, scrapes away the lubricant, and applies the lubricant onto the photosensitive element 3 be in the range of 3 denier to 8 denier and the density of the brush fibers be in the range of 20,000 fibers/inch$^2$ to 100,000 fiber/inch$^2$. If the thickness of the brush fiber is too small, pile flattening is likely to occur when the lubricant supply roller 31 comes into contact with the surface of the photosensitive element 3. On the contrary, if the thickness of the brush fibers is too large, it is difficult to increase the density of the brush fibers. If the density of the brush fibers is reduced, the number of brush fibers coming into contact with the surface of the photosensitive element 3 is reduced. Therefore, it is difficult to uniformly apply the lubricant. On the contrary, if the density of the brush fibers is too high, the gap between the brush fibers is reduced and the amount of scraped lubricant power adhered to the surface of the photosensitive element is reduced. Therefore, an insufficient amount of lubricant is applied.

For this reason, the lubricant supply roller 31 has the above-mentioned brush fiber thickness and density ranges capable of preventing pile flattening and uniformly applying the lubricant.

Furthermore, the lubricant of this image forming apparatus 1 contains a fatty acid metal salt (A) and an inorganic lubricant (B).

The fatty acid metal salt (A) is destroyed by electrification current to prevent destruction of the surface of the photosensitive element 3, but at the same time, lubricating action is maintained by the inorganic lubricant that is not destroyed with the electrification current, which makes it possible to maintain good cleaning of the photosensitive element 3.

Examples of the fatty acid metal salt (A) include barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate and a mixture thereof, but are not limited thereto. Furthermore, they may be used as mixed. Among them, zinc stearate is most preferably used in the present invention particularly from excellence in film formation property onto the photosensitive element.

The inorganic lubricant (B) in the invention refers to an inorganic compound that is cleaved and lubricates, or causes internal slippery. Examples of specific materials include talc, mica, boron nitride, molybdenum disulfide, tungsten disulfide, kaolin, smectite, hydrotalcite compounds, calcium fluoride, graphite, plate-like alumina, sericite, synthetic mica and the like, but are not limited thereto. Among them, boron nitride is most preferably used in the present invention from the fact that hexagonal net faces, in which atoms are tightly combined, are overlapped in a broad interval, and the force working between the layers is only weak van der Waals' force, whereby the boron nitride is easily cleaved, and lubricates. These inorganic lubricants may be surface-treated if necessary for the purpose of being imparted with hydrophobicity and the like.

The image forming apparatus of the invention is excellent in film formation property onto the photosensitive element 3, lubricating property and protective property by the material of zinc stearate that is the fatty acid metal salt, and further excellent in lubricating property by boron nitride that is the inorganic lubricant. Therefore, much better effects can be obtained in cleaning by performing a process of applying or attaching both of the fatty acid metal salt (A) and the inorganic lubricant (B).

Figure 5:
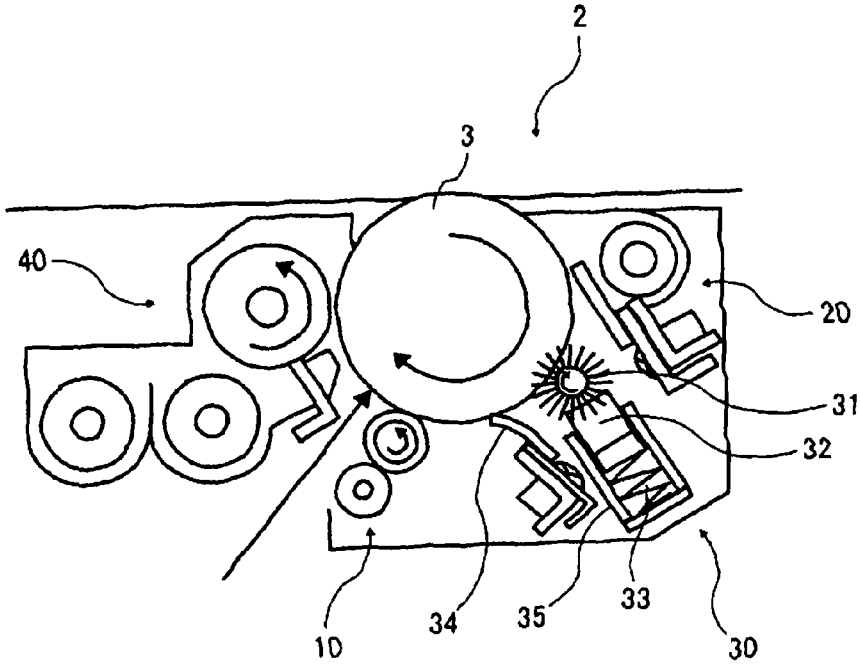
FIG. 5 is a diagram illustrating the structure of an image forming apparatus including a lubricant applying device according to the related art.

FIG. 5 is a diagram illustrating the structure of an image forming apparatus including the lubricant applying device according to the related art.

As shown in FIG. 5, in a process cartridge 2 including a photosensitive element 3 and a lubricant applying device 30, the lubricant applying device 30 is provided on the downstream side of a cleaning device 20 of the photosensitive element 3. In the process cartridge 2, in order to obtain high image quality and a long life span, a charging roller 11 is provided so as to face the photosensitive element 3 with a gap therebetween and is supplied with an AC voltage. In this way, a contaminant, such as toner from the photosensitive element 3, is less likely to adhere to the surface of the charging roller 11 and the contamination of the charging roller 11 is prevented, which results in a long life span. In addition, the charging device 10 includes the charging roller supplied with a voltage in which an AC voltage is superimposed on a DC voltage. Therefore, when an AC voltage is applied to the charging member, a sufficient amount of charging current flows and a stable charging potential is applied to the photosensitive element 3. As a result, a high-quality image is obtained.

Figure 6:
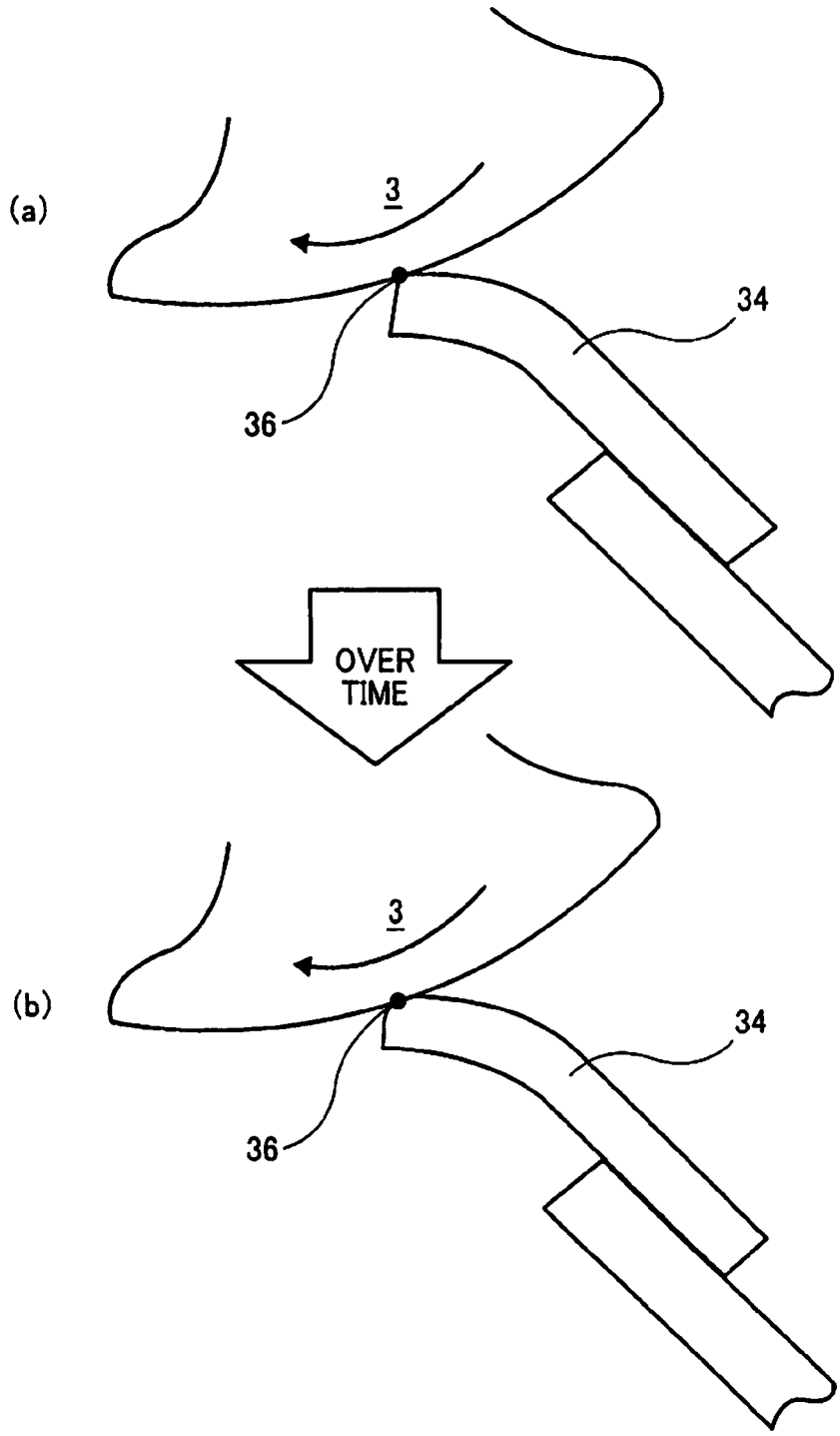
FIG. 6 is a diagram schematically illustrating a variation in a contact portion of a lubricant smoothing blade of the lubricant applying device according to the related art with a photosensitive element over time.

FIG. 6 schematically shows a variation in a contact portion between the photosensitive element and the lubricant smoothing blade of the lubricant applying device according to the related art over time. FIG. 6 is an enlarged view illustrating a variation in a contact portion 36 between the edge of the lubricant smoothing blade 34 and the photosensitive element 3 over time. As shown in FIG. 6(*a*), in the image forming apparatus 1, the edge of the lubricant smoothing blade 34 contacts the photosensitive element 3, and the lubricant smoothing blade 34 slides on the photosensitive element 3 when the photosensitive element 3 is rotated. As shown in FIG. 6(*b*), the edge of the lubricant smoothing blade 34 contacting the photosensitive element 3 is worn out by the contact sliding over time. When the edge of the lubricant smoothing blade 34 is worn out, the lubricant leaks out and a sufficient amount of lubricant is not applied, which results in the deterioration of a lubricant applying performance. When the lubricant leaks out, the surface of the charging roller 11 is contaminated with the lubricant, and the resistance of the roller increases. As a result, a color streak image is formed. In addition, when a sufficient amount of lubricant is not applied, the photosensitive element 3 is not sufficiently protected. Therefore, the photosensitive element 3 is damaged by a charging current and filming occurs in the photosensitive element 3. An image with uneven density is formed.

Figure 7:
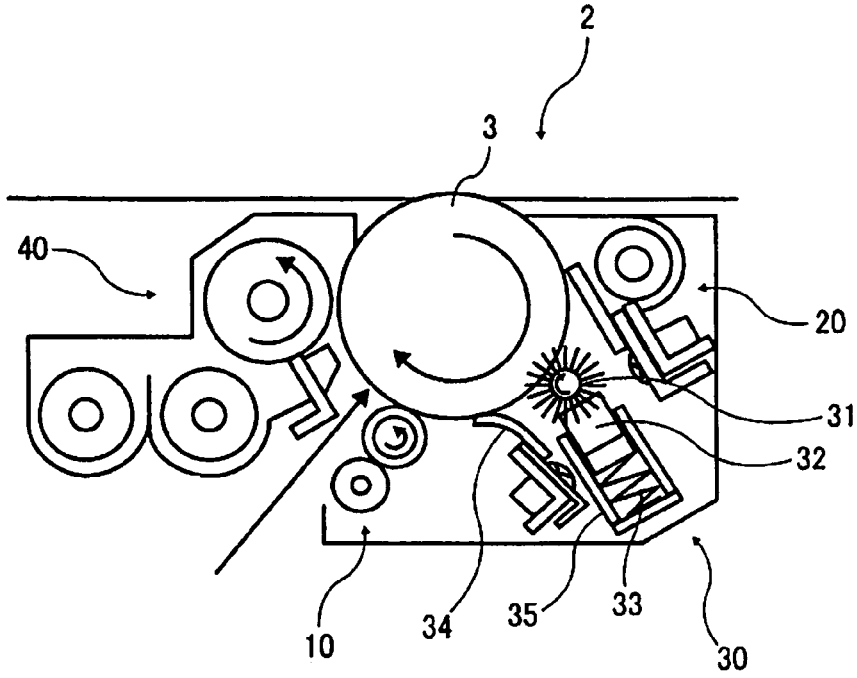
FIG. 7 is a diagram illustrating the structure of an embodiment of the lubricant applying device of the image forming apparatus according to the invention.

FIG. 7 is a diagram illustrating the structure of an embodiment of the lubricant applying device included in the image forming apparatus according to the invention. As shown in FIG. 7, a blade surface of the lubricant smoothing blade 34 contacts the photosensitive element 3. In the image forming apparatus 1, in order to stabilize the application of the lubricant, the lubricant applying device 30 is provided on the downstream side of the photosensitive element 3 in the rotational direction. When the lubricant applying device 30 is provided on the upstream side of the cleaning device 20 that cleans the toner remaining on the photosensitive element 3 with respect to the rotational direction of the photosensitive element 3, the area of an image increases, and the contact area between the lubricant and the surface of the photosensitive element 3 is reduced. As a result, a sufficient amount of lubricant is not applied. However, in the image forming apparatus 1 according to the embodiment of the invention, since the lubricant applying device 30 is provided on the downstream side of the cleaning device 20 for cleaning the photosensitive element 3 with respect to the rotational direction of the photosensitive element 3, the lubricant can be applied to the photosensitive element 3 without an excess and deficiency due to an image area ratio. Therefore, the lubricant can be stably applied.

In the lubricant applying device 30, the solid lubricant 32 is pressed against the lubricant supply roller 31 at predetermined pressure by the pressing spring 33, such as a spring. When the lubricant supply roller 31 is rotated, the lubricant is scraped away and then applied onto the surface of the photosensitive element 3. Then, the lubricant is smoothed into a thin film by the flexible lubricant smoothing blade 34 that is provided on the downstream side of the brush and is made of, for example, polyurethane.

The lubricant smoothing blade 34 comes into contact with the photosensitive element in a trailing direction. When the lubricant smoothing blade 34 comes into contact with the photosensitive element in the trailing direction, the amount of lubricant scraped away from the photosensitive element is reduced and lubricant application efficiency is improved.

Figure 8:
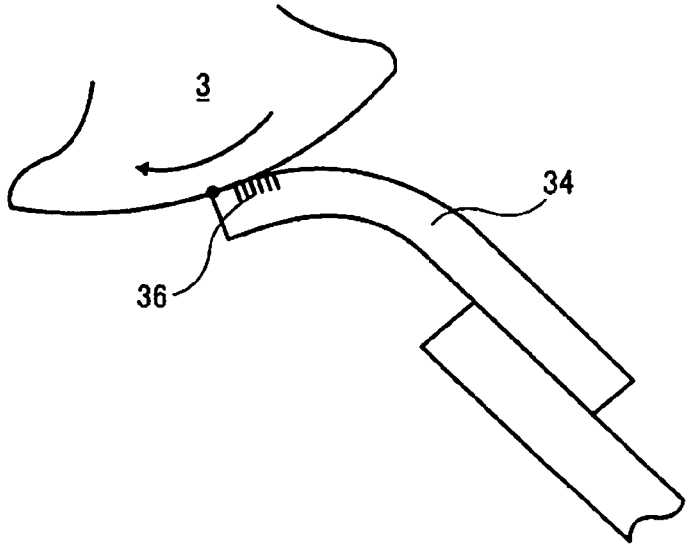
FIG. 8 is a diagram illustrating the contact of the lubricant smoothing blade of the lubricant applying device included in the image forming apparatus according to the invention.

FIG. 8 is a diagram illustrating the contact of the lubricant smoothing blade of the lubricant applying device included in the image forming apparatus according to the embodiment of the invention.

The flexible lubricant smoothing blade 34 comes into contact with the photosensitive element 3 in the trailing direction and the surface of the lubricant smoothing blade 34 contacts the photosensitive element 3.

Therefore, the contact area of the lubricant smoothing blade 34 with the photosensitive element 3 is considerably more than that when the edge of the lubricant smoothing blade 34 contacts the photosensitive element, and the contact pressure of the lubricant smoothing blade 34 is significantly lower than that when the edge of the lubricant smoothing blade 34 contacts the photosensitive element. Even when the lubricant smoothing blade 34 contacts the photosensitive element 3 and slides thereon, the lubricant smoothing blade 34 is not worn out by the rotation of the photosensitive element 3. Since the lubricant smoothing blade 34 is not worn out, it is possible to prevent the leakage of the lubricant or the application of an insufficient amount of lubricant for a long time. Therefore, it is possible to maintain a lubricant application performance at a high level.

In the image forming apparatus 1, in order to prevent a foreign material from being stuck to the edge of the cleaning blade 21, the photosensitive element 3 is stopped and then is rotated in a direction opposite to the image forming direction. The foreign material, which is caught during the forward rotation at the edge of the cleaning blade 21 that comes into contact with the photosensitive element in the counter direction, is removed by the reverse rotation. Therefore, even when a cleaning defect occurs due to the foreign material caught at the blade edge, the foreign material is removed from the edge by the reverse rotation, and thus it is possible to prevent a cleaning defect.

Furthermore, the lubricant smoothing blade 34 is in surface contact with the photosensitive element 3. Therefore, even when the photosensitive element is rotated in the reverse direction, the lubricant smoothing blade 34 is prevented from being bent backward, and thus the image forming apparatus 1 is prevented from being damaged.

Figure 9:
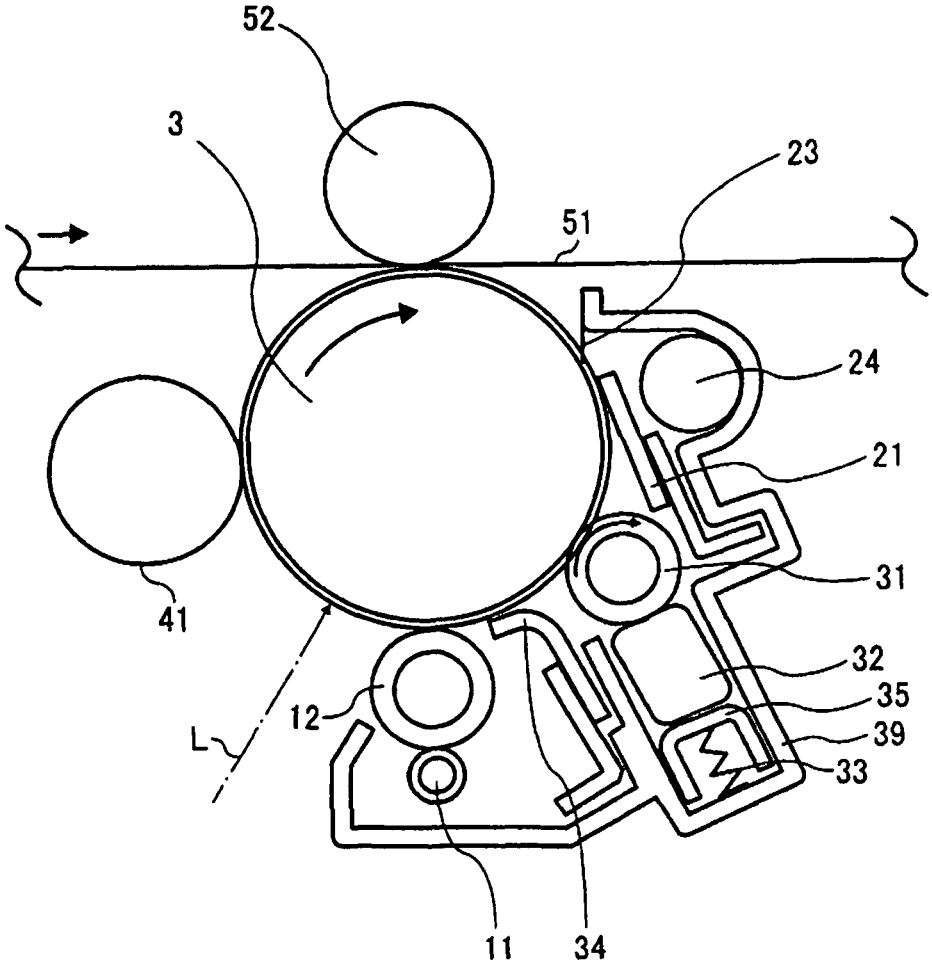
FIG. 9 is a diagram illustrating the structure of another embodiment of the lubricant applying device of the image forming apparatus according to the invention.

FIG. 9 is a diagram illustrating the structure of another embodiment of the lubricant applying device included in the image forming apparatus according to the invention.

A process cartridge 2 includes a photosensitive element 3, a cleaning device 20 including a cleaning blade 21, which is a cleaning member that removes, for example, toner (hereinafter, referred to as excess toner) which remains after transfer and is adhered to the surface of the photosensitive element 3, a scattering prevention sheet 23 that prevents the scattering of excess toner scraped away by the cleaning blade 21, and a powder transport coil 24 that transports, for example, excess toner, a lubricant applying device 30 including a lubricant supply roller 31, a solid lubricant 32, a solid lubricant holding member 35 that holds the solid lubricant 32, a pressing spring 33 that presses the solid lubricant 32 against the lubricant supply roller 31, and a lubricant smoothing blade 34 that smoothes the lubricant supplied to the photosensitive element 3 into a thin film, a charging device 10 including a charging roller 11 that uniformly charges the surface of the photosensitive element 3, a charge cleaning roller 12 that cleans the charging roller, and a housing 201 that directly or indirectly holds each of the above-mentioned components.

As can be seen from FIG. 9, the lubricant supply roller 31 supplies the lubricant to the surface of the photosensitive element 3 cleaned by the cleaning blade 21. Therefore, it is possible to uniformly supply the lubricant without being affected by a foreign material, such as excess toner.

In this way, it is possible to stably supply the lubricant to the surface of the photosensitive element 3 even under the condition that an image with a large area is continuously output where the largest amount of toner remains after transfer, among the conditions of use. Therefore, it is possible to prevent the formation of a contaminated streak image due to a cleaning defect without damaging the function of the cleaning blade 21 and thus improve the cleaning performance and reliability of the process cartridge 2 and the image forming apparatus 1.

Since the lubricant is uniformly applied onto the photosensitive element 3, it is possible to improve the durability of the cleaning blade 21 and increase the life span of the cleaning device 20.

As shown in FIG. 9, the lubricant smoothing blade 34 is used by a trailing method and a belly contact method. In the belly contact, a surface, which is retracted from the edge, mainly comes into contact with the photosensitive element. Therefore, it is possible to reduce the contact surface pressure of the lubricant smoothing blade 34 and significantly reduce the amount of abrasion of the lubricant smoothing blade 34 as compared to the related art.

Specifically, when the edge of the lubricant smoothing blade 34 contacts the photosensitive element at a contact pressure of 20 g/cm and the movement distance of the surface of the photosensitive element 3 is about 80 km, the amount of abrasion of the lubricant smoothing blade 34 is an abrasion depth (an abrasion distance in a direction away from the photosensitive element 3) of about 60 μm to 100 μm. In contrast, when the belly contact method is used at the same contact pressure as described above and the movement distance of the surface of the photosensitive element 3 is about 200 km, the amount of abrasion is an abrasion depth of 5 μm or less. Therefore, the durability of the lubricant smoothing blade is significantly improved.

As shown in FIG. 9, the direction (the longitudinal direction of the lubricant smoothing blade 34 without being curved by the photosensitive element 3 in a cross-sectional view) of the lubricant smoothing blade 34 is aligned with substantially the center of the photosensitive element 3. In this way, it is possible to reduce the arrangement area of the lubricant smoothing blade 34 and thus reduce the size of the lubricant applying device 20.

In FIG. 9, a brush roller is used as the lubricant supply roller 31. The use of the brush roller makes it possible to supply the lubricant without particularly increasing the torque of the photosensitive element 3 even when the rotational direction of the lubricant supply roller 31 is the counter direction.

The lubricant supply roller 31 may be a polyurethane foam roller. In this case, torque increases, but particularly, it is possible to uniformly supply the lubricant and thus supply the lubricant with high efficiency.

The rotational direction of the lubricant supply roller 31 is not limited to the counter direction. As shown in FIG. 9, when the lubricant supply roller 31 is rotated in the counter direction, the effect of removing a foreign material adhered to the surface of the photosensitive element 3 is improved at the same time as the lubricant is supplied. On the contrary, when the lubricant supply roller 31 is rotated in the forward direction, the torque of the photosensitive element 3 is reduced and the effect of reducing energy is obtained.

Figure 10:
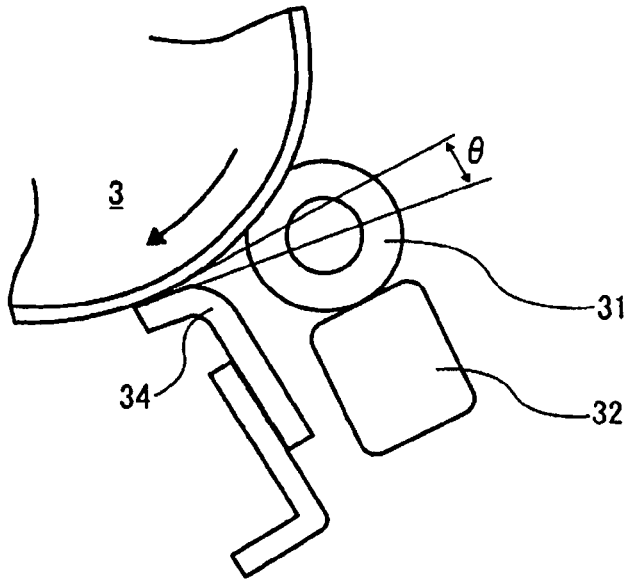
FIG. 10 is a diagram illustrating the angle formed between the photosensitive element and the lubricant smoothing blade of the lubricant applying device included in the image forming apparatus according to the invention.

FIG. 10 is a diagram illustrating the angle formed between the photosensitive element and the lubricant smoothing blade of the lubricant applying device included in the image forming apparatus according to the embodiment of the invention.

As shown in FIG. 10, in the belly contact method, since the angle θ between the photosensitive element 3 and the lubricant smoothing blade 34 is very small, a foreign material is likely to be caught between the photosensitive element 3 and the lubricant smoothing blade 34. In addition, since there is no function of removing the foreign material with the edge of the lubricant smoothing blade 34, the caught foreign material is less likely to be removed.

In particular, when a foreign material is inserted into a narrow portion between the photosensitive element 3 and the lubricant smoothing blade 34 while the photosensitive element 3 is rotated in the forward direction in which an image is formed, the foreign material is hardened and adhered to the photosensitive element 3 or the lubricant smoothing blade 34 and the photosensitive element 3 is damaged. Even when exposure is performed, a surface potential is not reduced, which may cause an abnormal image.

Figure 11:
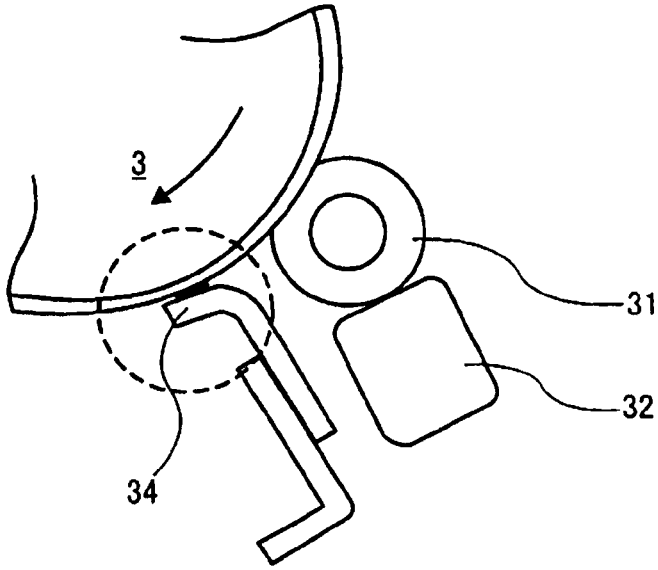
FIG. 11 is a diagram illustrating a state in which a foreign material is caught between the photosensitive element and the lubricant smoothing blade.

FIG. 11 is a diagram illustrating a state in which a foreign material is caught between the photosensitive element and the lubricant smoothing blade.

As represented by a circle in FIG. 11, the foreign material is inserted into a narrow portion between the photosensitive element 3 and the lubricant smoothing blade 34.

As described above, the angle θ between the photosensitive element 3 and the lubricant smoothing blade 34 is small, and it is very difficult for the foreign material caught between the photosensitive element 3 and the lubricant smoothing blade 34 to escape from the narrow portion.

Figure 12:
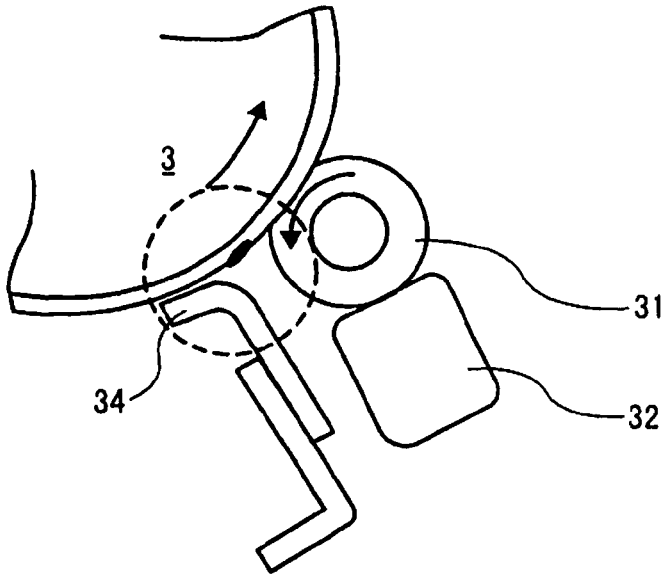
FIG. 12 is a diagram illustrating the state of the foreign material when the photosensitive element is rotated in the opposite direction.

FIG. 12 is a diagram illustrating the state of the foreign material when the photosensitive element is rotated in the reverse direction.

As represented by a circle in FIG. 12, when the photosensitive element 3 is rotated in the reverse direction, most of the foreign material caught between the photosensitive element 3 and the lubricant smoothing blade 34 adheres to the photosensitive element 3 and is then moved by the rotation of the photosensitive element 3 in the reverse direction.

In this case, if the amount of movement of the foreign material by the rotation of the photosensitive element 3 in the reverse direction is less than L1 in FIG. 15, which will be described below, that is, when the rotation of the photosensitive element 3 in the reverse direction is stopped before the foreign material reaches the lubricant supply roller 31, the foreign material that adheres to the photosensitive element 3 and is caught between the photosensitive element 3 and the lubricant smoothing blade 34 does not come off from the photosensitive element 3 since the foreign material does not contact any member between the photosensitive element 3 and the lubricant smoothing blade 34, and is caught between the photosensitive element 3 and the lubricant smoothing blade 34 again in the next normal operation. In this case, the foreign material remains in states shown in FIGS. 11 and 12.

Figure 13:
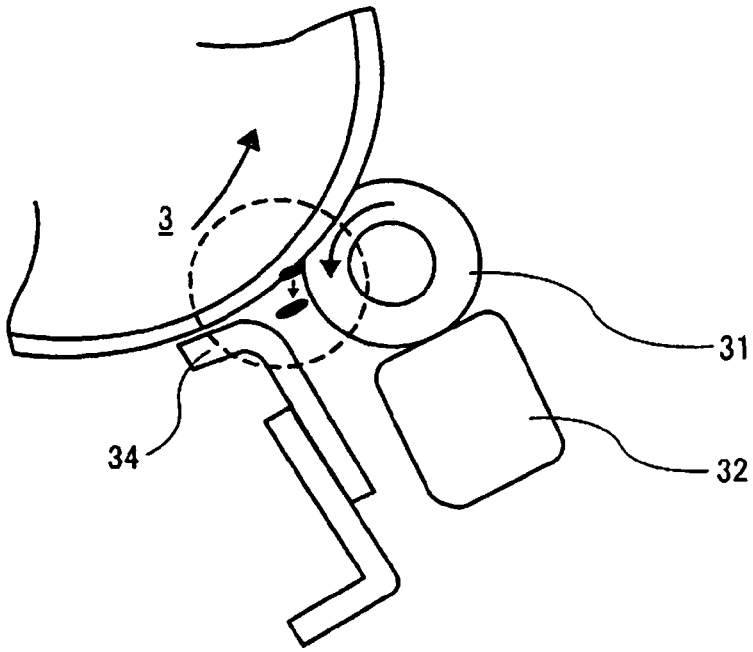
FIG. 13 is a diagram illustrating a state when the photosensitive element is rotated in the opposite direction to contact the foreign material with a lubricant supply roller.

FIG. 13 is a diagram illustrating a state in which the photosensitive element is rotated in the reverse direction to contact the foreign material with the lubricant supply roller.

As represented by a circle in FIG. 13, when the photosensitive element 3 is rotated in the reverse direction, most of the foreign material caught between the photosensitive element 3 and the lubricant smoothing blade 34 adheres to the photosensitive element 3 and is then moved. In this case, if the amount of movement of the foreign material by the rotation of the photosensitive element in the reverse direction operation is more than L1 in FIG. 15, which will be described below, that is, when the foreign material reaches the lubricant supply roller 31, the lubricant supply roller 31, such as a brush roller, can be rotated in a direction opposite to the rotational direction when the lubricant is supplied to scrape up the rear end of the foreign material on the photosensitive element 3, as viewed from the rotational direction of the photosensitive element 3, thereby brushing off the foreign material.

In this case, when the lubricant supply roller 31 is rotated in the same direction as that when the lubricant is supplied, the foreign material is caught between the lubricant supply roller 31 and the photosensitive element 3, which is not preferable. It is preferable that the lubricant supply roller 31 be rotated in a direction which is opposite to the rotational direction of the photosensitive element 3 and in which the lubricant supply roller 31 collides with the photosensitive element 3.

Figure 14:
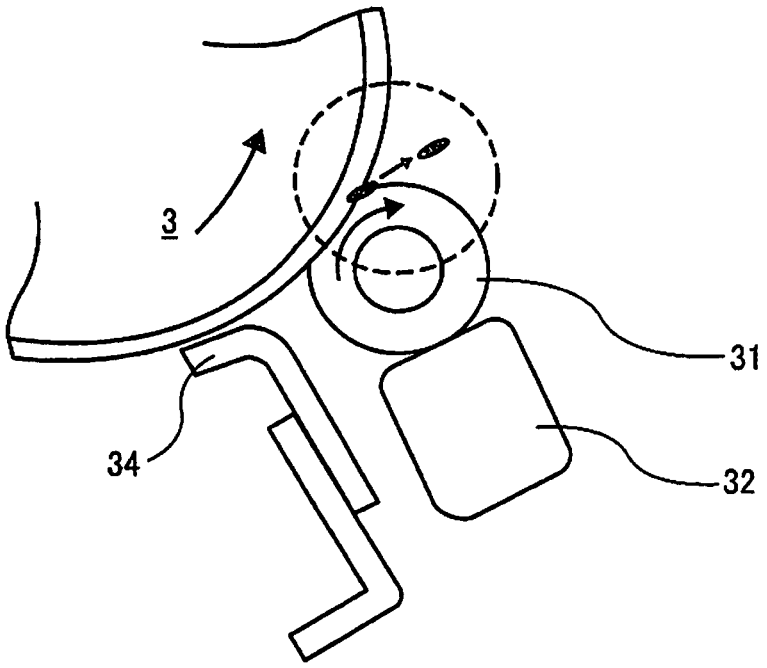
FIG. 14 is a diagram illustrating another state when the photosensitive element is rotated in the opposite direction to contact the foreign material with the lubricant supply roller.

FIG. 14 is a diagram illustrating another state in which the photosensitive element is rotated in the reverse direction to contact a foreign material with the lubricant supply roller.

As represented by a circle in FIG. 14, when the photosensitive element 3 is rotated in the reverse direction, most the foreign material caught between the photosensitive element 3 and the lubricant smoothing blade 34 adheres to the photosensitive element 3 and is then moved by the rotation of the photosensitive element 3 in the reverse direction. In this case, if the amount of movement of the foreign material by the rotation of the photosensitive element 3 in the reverse direction is more than L2 in FIG. 15, which will be described below, that is, when the foreign material passes by a contact portion of the lubricant supply roller 31 with the photosensitive element 3, the lubricant supply roller 31, such as a brush roller, can be rotated in the same direction as that in which the lubricant is supplied to scrape up the rear end of the foreign material on the photosensitive element 3, as viewed from the rotational direction of the photosensitive element 3, thereby brushing off the foreign material.

Figure 15:
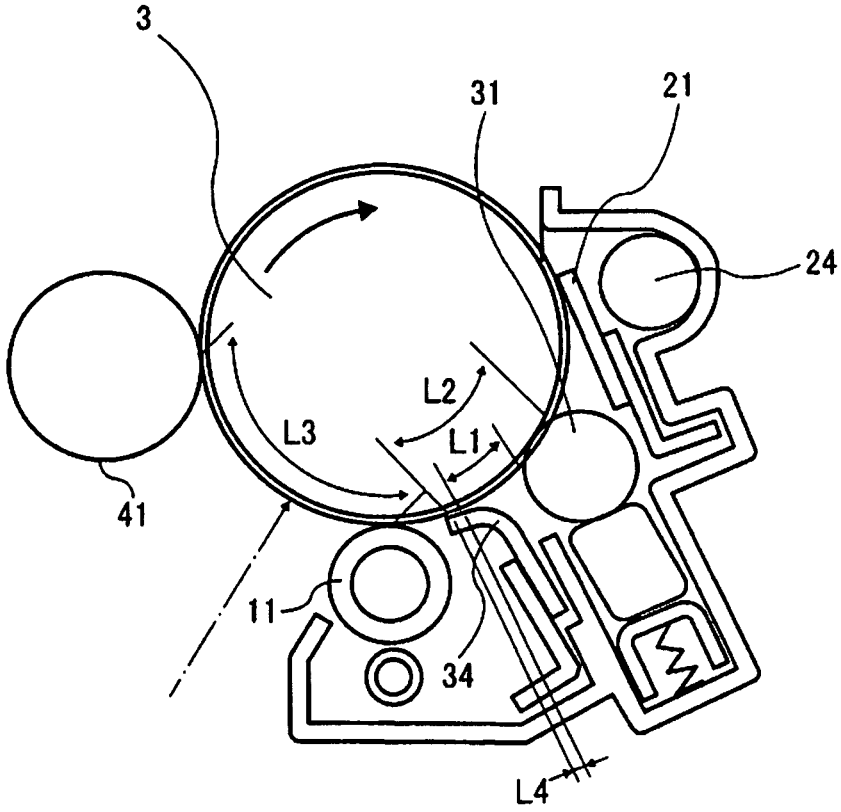
FIG. 15 is a diagram illustrating a movement operation of the image forming apparatus according to the invention.

As shown in FIG. 14, when the amount of movement of the foreign material by the rotation of the photosensitive element 3 in the reverse direction is more than L2 in FIG. 15, it is possible to brush off the foreign material regardless of the rotational direction of the lubricant supply roller 31.

FIG. 15 is a diagram illustrating a movement operation of the image forming apparatus according to the embodiment of the invention.

As shown in FIG. 15, from the positional relationship between the foreign material on the photosensitive element 3 and the lubricant supply roller 31, the amount of movement of the foreign material by the rotation of the photosensitive element 3 in the reverse direction after a normal operation is stopped is more than L1 in FIG. 15. In this way, it is possible to brush off the foreign material with the lubricant supply roller 31 and prevent the foreign material from being caught in the lubricant smoothing blade 34 again.

The amount L1 of movement is the shortest distance between the lubricant supply roller 31 and a contact portion of the surface of the photosensitive element 3 with the lubricant smoothing blade 34.

It is more preferable that the amount of movement of the foreign material by the rotation of the photosensitive element 3 in the reverse direction after a normal operation is stopped be equal to or more than L2. In this case, the effect of brushing off the foreign material is obtained in the next normal operation as well as the operation in the reverse direction.

The amount L2 of movement is the longest distance between the lubricant supply roller 31 and the contact portion of the surface of the photosensitive element 3 with the lubricant smoothing blade 34.

It is preferable that the amount of movement of the foreign material by the rotation of the photosensitive element 3 in the reverse direction after a normal operation is stopped be equal to or less than L3.

The amount L3 of movement is the distance between a contact portion of the surface of the photosensitive element 3 with the developing roller 41 and the contact portion of the surface of the photosensitive element 3 with the lubricant smoothing blade 34.

In this case, it is possible to remove the foreign material caught in the lubricant smoothing blade 34 without adhesion of the developer (regardless of toner and magnetic body), which has adhered to the photosensitive element 3 by the developing roller 41, to the charging roller 11.

The rotational direction of the lubricant supply roller 31 may be the same as or opposite to the rotational direction of the photosensitive element 3. However, it is preferable that the rotational direction of the lubricant supply roller 31 be opposite to the rotational direction of the photosensitive element 3 in order to improve the effect of brushing off the foreign material on the photosensitive element 3 and prevent the foreign material from being caught in the lubricant smoothing blade 34.

It is most preferable that the photosensitive element 3 be rotated in the reverse direction each time the operation of the photosensitive element 3 is stopped, in order to improve the effect of brushing off the foreign material on the photosensitive element 3 and prevent the foreign material from being caught in the lubricant smoothing blade 34. However, even when the photosensitive element 3 is rotated in the reverse direction after the movement distance in the normal operation is more than a predetermined value (for example, 1 km), it is expected to obtain the above-mentioned effect.

The latter example is preferable to reduce the burden on, for example, a sliding member, a gear, a shaft bearing, and a motor due to the rotation of the photosensitive element in the reverse direction.

Figure 16:
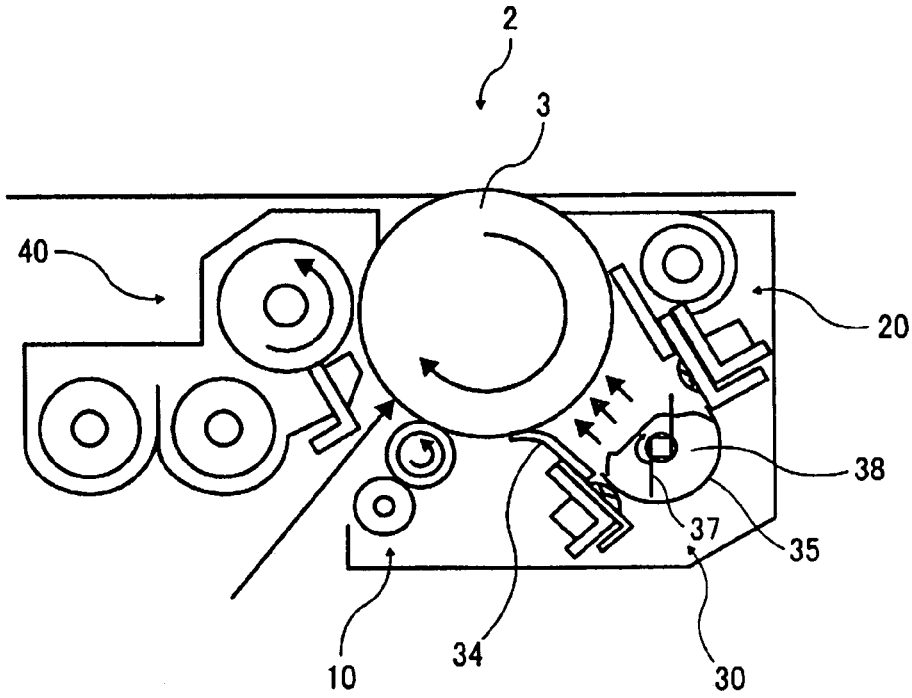
FIG. 16 is a diagram illustrating another embodiment of the lubricant applying device of the image forming apparatus according to the invention.

FIG. 16 is a diagram illustrating another embodiment of the lubricant applying device included in the image forming apparatus according to the invention. In this embodiment, instead of the structure in which the lubricant supply roller 31 scrapes away the rod-shaped solid lubricant 32 and applies the lubricant onto the surface of the photosensitive element 3, the following structure is used: a stirring member 37 in which a flexible member, such as Myler, is attached to a shaft portion is used to blow a powder lubricant 38 to the surface of the photosensitive element 3, thereby applying the powder lubricant 38 onto the surface of the photosensitive element 3. Because the powder lubricant 38 does not need to be shaped, and a member, such as the lubricant supply roller 31 is not needed, it is possible to reduce a manufacturing cost.

In the image forming apparatus 1 according to the embodiment of the invention, polymerized toner, which is toner for a page printer that is obtained by chemical reaction using a liquid medium, is used. The pulverized toner according to the related art has particles with different sizes and shapes and electric characteristics are likely to vary when the pulverized toner is transferred to the photosensitive drum or sheet. In contrast, the polymerized toner has particles with a uniform size, a shape close to a sphere, and a small diameter. Therefore, it is possible to improve development characteristics and a transfer performance and thus obtain a high-quality image.

The toner is composed of at least a binder resin and a colorant, and a lubricant that reduces friction, which is externally added to the toner surface. In addition, the toner may contain a charge control agent that controls charging property of the toner, and a release agent that improves release property for the fixing, etc., and may also have an external additive that imparts flowing property.

Examples of the binder resin include ester resin, vinyl-based resin, amide resin, epoxy resin, silicone resin, etc., and particularly the binder resin is preferably vinyl-based resin. Examples of specific binder resins that may be used include homopolymers of styrene and substitution product thereof such as polystyrene, poly P-chlorostyrene and polyvinyl toluene, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-acrylonitrile copolymers, styrene-vinylmethyl ether copolymers, styrene-butadiene copolymers, styrene-methyl methacrylate-butyl acrylate copolymers, etc.

All commonly known dyes and pigments may be used as a colorant. Examples of the colorant that may be used include carbon black, nigrosine dye, iron black, naphthol yellow S, hansa yellow (10G, 5G, G), cadmium yellow, yellow iron oxide, yellow ocher, chrome yellow, titanium yellow, polyazo yellow, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, indigo, ultramarine blue, Prussian blue, anthraquinone blue, fast violet B, methyl violate lake, cobalt purple, Manganese purple, dioxane violate, anthraquinone violet, chrome green, zinc green, pigment green B, naphthol green B, green gold, titanium oxide, zinc white, lithopone and mixtures thereof. A content of the colorant is normally 1% to 15%, and preferably 3% to 10% with respect to the toner.

As the charge control agent, for example, salicylic acid compounds, nigrosine-based dyes, quaternary ammonium salt compounds, alkylpyridinium compounds, etc. may be used. The content is normally 0.1 to 5%, preferably 1 to 3% with respect to the toner.

As the release agent, for example, polyolefin waxes such as low molecular polyethylene, low molecular polypropylene and low molecular polyethylene-polypropylene copolymer, ester waxes such as fatty acid lower alcohol ester, fatty acid higher alcohol ester and fatty acid polyhydric alcohol ester, amide waxes, etc. may be used. The content is normally 0.5 to 10%, preferably 1 to 5% with respect to the toner.

It is preferable that the degree of circularity of toner be equal to or more than 0.92. The degree SR of circularity is defined as (the boundary length of a circle having the same area as the projected area of a particle/the boundary length of a projected image of a particle)×100%. As the shape of the toner is close to a sphere, the degree of circularity is close to 100%. In the image forming apparatus according to the related art, when the toner is used, in some cases, the toner is not sufficiently scraped away by a cleaning member, such as a cleaning blade. This is caused by the rolling of the toner on the photosensitive element 3. In order to prevent the insufficient scraping of the toner, it is considered that the pressing force of the cleaning blade against the photosensitive element 3 increases. However, in this case, strong pressing force affects the rotation or movement accuracy of the photosensitive element 3, which causes banding. In contrast, the lubricant is applied onto the surface of the photosensitive element 3 from both an applying unit 17 and the toner to reduce the friction coefficient of the surface of the photosensitive element 3. In this way, it is possible to increase a transfer ratio during transfer to reduce the remaining toner, thereby reducing the cleaning load of the cleaning blade. In addition, even when the cleaning blade comes into contact with the photosensitive element 3 with strong force, it is possible to perform cleaning without any banding.

For the degree of circularity, toner particles manufactured by dry mill are thermally or mechanically changed to a spherical shape. For example, a thermal current and parent toner particles are sprayed to, for example, an atomizer to thermally change the toner particles to a spherical shape. In addition, both the parent toner particles and a mixed medium with low specific gravity, such as glass, are put into a mixer, such as a ball mill, and are then stirred, thereby mechanically changing the toner particles to a spherical shape. However, in the process of thermally changing the toner particles to a spherical shape, the toner particles are agglutinated into parent toner particles with a large diameter. In the process of mechanically changing the toner particles to a spherical shape, fine powder is generated. Therefore, the two processes require a sorting process. In addition, for toner manufactured in a water-based solvent, strong stirring force is applied in a process of removing the solvent to control the shape of the toner particles. A fluidity giving agent may be added to the toner. Examples of the fluidity giving agent include fine particles of metal oxides, such as silica, titania, alumina, magnesia, zirconia, ferrite, and magnetite and fine particles of metal oxides obtained by processing these fine particles with a silane coupling agent, a titanate coupling agent, and zircon-aluminate. Silica or titania hydrophobized with a coupling agent is preferable. As the primary particle diameter of silica is reduced, the effect of giving fluidity is improved. The use of titania makes it possible to control the amount of charged toner. It is more preferable to add combinations of these materials.

It is preferable that the amount of lubricant externally added to the toner be in the range of 0.1% to 2.0%. When the amount of lubricant added is less than 0.1%, the amount of lubricant supplied to the photosensitive element 3 is reduced and it is difficult to reduce the friction coefficient of the photosensitive element 3. When the amount of lubricant added is more than 2.0%, the lubricant adheres from the photosensitive element 3 to, for example, a charging roller 14*a*, which causes an abnormal image.

As the volume average particle diameter (Dv) of the toner is reduced, thin line reproducibility is improved. Therefore, toner with a volume average particle diameter of 8 μm or less is used. However, when the particle diameter is reduced, a developing performance and a cleaning performance are reduced. It is preferable that the particle diameter be at least equal to or more than 3 μm. When the particle diameter is less than 3 μm, the amount of toner with a very small particle diameter which is less likely to be developed increases on the surface of the carrier or the developing roller 41, and the contact and friction between the other toner and the carrier or the developing roller 41 are insufficient. As a result, the amount of oppositely-charged toner increases and an abnormal image, such as ground fogging, is formed, which is not preferable. It is preferable that a particle diameter distribution represented by the ratio (Dv/Dn) of the volume average particle diameter (Dv) to a number average particle diameter (Dn) be in the range of 1.05 to 1.40. It is possible to uniformize the distribution of the amount of charged toner by sharpening the particle diameter distribution. When the ratio Dv/Dn is more than 1.40, the distribution of the amount of charged toner is widened, and the amount of oppositely-charged toner T1 increases, which makes it difficult to obtain a high-quality image. When the ratio Dv/Dn is less than 1.05, it is difficult to manufacture toner and this condition is not practical. The toner particle diameter is obtained by averaging the diameters of 50,000 particles measured by Coulter Counter Multisizer (manufactured by Coulter Electronics, Inc.) using an aperture having a hole for measurement with a size of 50 μm which corresponds to a toner particle diameter to be measured.

Figure 17A:
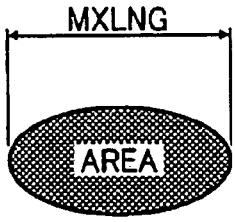
FIGS. 17A and 17B are diagrams illustrating the degree of sphericity of toner used in the image forming apparatus according to the invention.
Figure 17B:
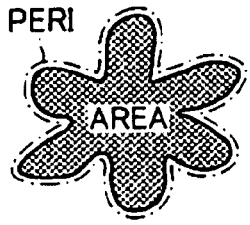

It is preferable that the toner have a shape coefficient SF-1 in the range of 100 to 180 and a shape coefficient SF-2 in the range of 100 to 180 in the degree of circularity. FIGS. 17A and 17B are diagrams illustrating the degree of sphericity of the toner used by the image forming apparatus according to the embodiment of the invention. FIG. 17A is a diagram illustrating the shape coefficient SF-1 and FIG. 17B is a diagram illustrating the shape coefficient SF-2. The shape coefficient SF-1 indicates the percentage of a circle in the shape of the toner and is represented by the following Expression (1).

$$SF\text{-}1=\{(MXLNG)2/\mathrm{AREA}\}\times(100\pi/4) \quad (1)$$

The shape coefficient SF-1 is a value obtained by dividing the square of the maximum length MXLNG of a projected image of the toner on a two-dimensional surface by the area AREA of a figure and multiplying the divided value by 100π/4.

When the value of SF-1 is 100, the toner has a spherical shape. As the value of SF-1 increases, the shape of the toner becomes indefinite.

The shape coefficient SF-2 indicates the percentage of concave and convex portions in the shape of the toner and is represented by the following Expression (2).

$$SF\text{-}2=\{(PERI)2/\mathrm{AREA}\}\times(100\pi/4) \quad (2)$$

The shape coefficient SF-2 is a value obtained by dividing the square of the peripheral length PERI of a projected image of the toner on a two-dimensional surface by the area AREA of a figure and multiplying the divided value by 100π/4.

When the value of SF-2 is 100, there are no concave and convex portions on the surface of the toner. As the value of SF-2 increases, the number of concave and convex portions on the surface of the toner increases.

Specifically, the shape coefficients were measured by capturing the image of the toner using a scanning electron microscope (S-800 manufactured by Hitachi, Ltd.) and analyzing the image using an image analyzer (LUSEX3 manufactured by Nireco Corporation).

When the shape of the toner is close to a sphere, the toner comes into point contact with the toner or the photosensitive element 3 and the absorption force between the toner particles is reduced. As a result, fluidity increases. In addition, the absorption force between the toner and the photosensitive element 3 is reduced and the transfer ratio increases. It is easy to collect the oppositely-charged toner T1 with a temporary holding device.

The shape coefficients SF-1 and SF-2 of the toner may be equal to or more than 100. As the values of SF-1 and SF-2 increases the larger the amount of oppositely-charged toner T1 increases too. In addition, the distribution of the amount of charged toner is widened and the load of the temporary holding device increases. Therefore, it is preferable that the value of SF-1 be less than 180 and the value of SF-2 be less than 180.

Figure 18A:
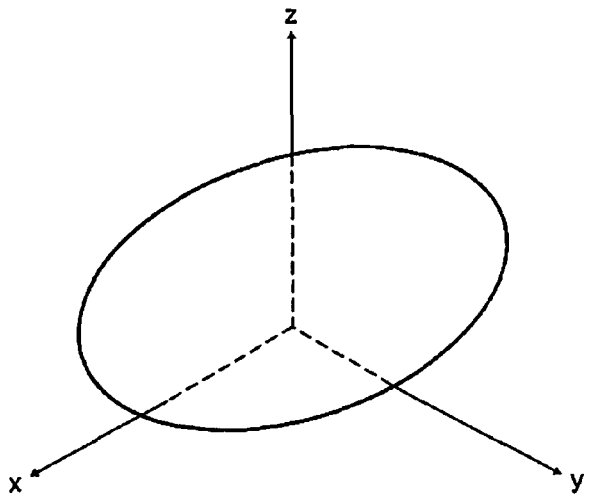
FIGS. 18A to 18C are diagrams illustrating the shape of toner used in the image forming apparatus according to the invention.
Figure 18B:
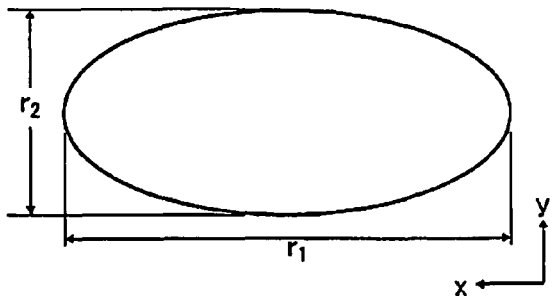
Figure 18C:
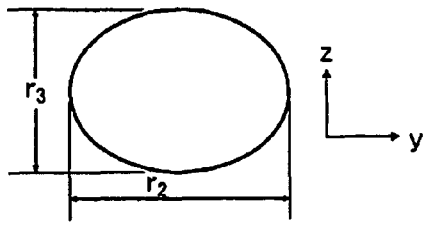

The toner used in the image forming apparatus may have a substantially circular shape. FIGS. 18A to 18C are diagrams illustrating the shape of the toner used by the image forming apparatus according to the embodiment of the invention. In FIGS. 18A to 18C, the X-axis indicates a long axis r1, which is the longest axis of the toner, the Y-axis indicates a short axis r2, which is the second longest axis of the toner, and the Z-axis indicates a thickness r3, which is the shortest axis of the toner. The axes have the following relationship: the long axis r1≥ the short axis r2≥ the thickness r3.

The toner has a substantially spherical shape in which the ratio (r2/r1) of the short axis to the long axis is in the range of 0.5 to 1.0 and the ratio (r3/r2) of the thickness to the short axis is in the range of 0.7 to 1.0. When the ratio (r2/r1) of the short axis to the long axis is less than 0.5, the toner has a substantially indefinite shape and the distribution of the amount of charged toner is widened. When the ratio (r3/r2) of the thickness to the short axis is less than 0.7, the toner has a substantially indefinite shape and the distribution of the amount of charged toner is widened. In particular, when the ratio (r3/r2) of the thickness to the short axis is 1.0, the toner has a substantially spherical shape and the distribution of the amount of charged toner is narrowed.

The size of the toner was measured by the scanning electron microscope (SEM) while changing the angle of view.

The shape of the toner can be controlled by a method of manufacturing the toner. For example, toners obtained by dry milling have uneven surfaces, and the shapes of the toners are not constant, and irregular. However, these toners obtained by dry milling may be converted to toners of roughly true sphere by applying mechanical or thermal treatment. Toners obtained by a method of manufacturing the toner in which droplets are formed through suspension polymerization or emulsion polymerization, frequently have smooth surfaces, and have the shape of roughly true sphere. Furthermore, the shape may be converted to ellipsoid by applying shear force by stirring in the course of the reaction in a solvent.

Furthermore, the toner having such roughly sphere shape is preferably a toner obtained by the crosslinking reaction and/or the extension reaction of a toner composition containing polyester prepolymer having a functional group including a nitrogen atom, polyester, a colorant and a release agent in an aqueous medium in the presence of resin microparticles.

Hereinafter, component materials of the toner and preferred manufacturing methods will be explained.

Polyester

Polyester is obtained by a polycondensation reaction of a polyhydric alcohol compound and a polycarboxylic compound.

Examples of the polyhydric alcohol compounds (PO) include dihydric alcohols (DIO) and trihydric or higher polyhydric alcohols (TO), and the polyhydric alcohol compounds (PO) is preferably (DIO) by itself or a mixture of (DIO) and a small amount of (TO). Examples of the dihydric alcohol (DIO) include alkylene glycols (ethylene glycol, 1,2-propylene glycol, 1,3-propylene glycol, 1,4-butanediol, 1,6-hexanediol and the like); alkylene ether glycols (diethylene glycol, triethylene glycol, dipropylene glycol, polyethylene glycol, polypropylene glycol, polytetramethylene ether glycol and the like); alicyclic diols (1,4-cyclohexane dimethanol, hydrogenated bisphenol A and the like); bisphenols (bisphenol A, bisphenol F, bisphenol S and the like); alkylene oxide (ethylene oxide, propylene oxide, butylene oxide and the like) adducts of the above alicyclic diols; alkylene oxide (ethylene oxide, propylene oxide, butylene oxide and the like) adducts of the above bisphenols and the like. Among them, the dihydric alcohol (DIO) is preferably alkylene glycols having 2 to 12 carbon atoms and alkylene oxide adducts of bisphenols, and especially preferably alkylene oxide adducts of bisphenols and a combination of alkylene oxide adducts of bisphenols and alkylene glycols having 2 to 12 carbon atoms. Examples of the trihydric or higher polyhydric alcohol include trihydric to octahydric alcohol or higher polyhydric aliphatic alcohol (TO) (glycerin, trimethylol ethane, trimethylol propane, pentaerythritol, sorbitol and the like); triphenols or higher polyphenols (trisphenol PA, phenol novolac, cresol novolac and the like); alkylene oxide adducts of the above triphenols or higher polyphenols, and the like.

Examples of the polycarboxylic acids (PC) include dicarboxylic acid (DIC) and tricarboxylic or higher polycarboxylic acids (TC), and the polycarboxylic acids (PC) is preferably (DIC) by itself or a mixture of (DIC) and a small amount of (TC). Examples of the dicarboxylic acids (DIC) include alkylene dicarboxylic acids (succinic acid, adipic acid, sebacic acid, etc.), alkenylene dicarboxylic acids (maleic acid, fumaric acid, etc.), and aromatic carboxylic acids (phthalic acid, isophthalic acid, terephthalic acid, naphthalene dicarbonic acid, etc.). Among them, the dicarboxylic acid (DIC) is preferably alkenylene dicarboxylic acids having 4 to 20 carbon atoms and aromatic dicarboxylic acids having 8 to 20 carbon atoms. Examples of tricarboxylic or higher polycarboxylic acids (TC) include aromatic polycarboxylic acids having 9 to 20 carbon atoms (trimellitic acid, pyromellitic acid, etc.). Further, acid anhydrides of the above compounds, or lower alkyl esters (methyl ester, ethyl ester, isopropyl ester, etc.) may be also allowed to react with the polyhydric alcohols (PO) to obtain the polycarboxylic acids (pc).

A ratio of the polyhydric alcohols (PO) to the polycarboxylic acids (PC), which is expressed as an equivalent ratio (OH)/(COOH) of a hydroxyl group (OH) to a carboxyl group (COOH), is normally 2/1 to 1/1, preferably 1.5/1 to 1/1, and further preferably 1.3/1 to 1.02/1.

In the polycondensation reaction of the polyhydric alcohols (PO) and the polycarboxylic acids (PC), the polyhydric alcohols (PO) and the polycarboxylic acids (PC) are heated to 150° C. to 280° C. in the presence of a commonly known esterification catalyst such as tetrabutoxy titanate, dibutyltin oxide, etc. Pressure is reduced if necessary and water generated during the reaction is distilled off to obtain polyester that has a hydroxyl group. A hydroxyl group number of greater than or equal to 5 is preferable for the polyester. An acid number of the polyester is normally 1 to 30, and preferably 5 to 20. Causing the polyester to have the acid number increases the negative electrostatic charge of the toner. Further, when fixing the toner on a recording sheet, the acid number enhances affinity of the recording sheet and the toner and also enhances low temperature fixability. However, if the acid number exceeds 30, the stability of the electrostatic charge is adversely affected, especially with respect to environmental variations. Further, a weight average molecular weight of the polyester is 10,000 to 400,000 and preferably 20,000 to 200,000. A weight average molecular weight of less than 10,000 causes anti-offset ability of the toner to deteriorate and thus is not preferable. Further, the weight average molecular weight exceeding 400,000 causes the low temperature fixability of the toner to deteriorate and thus is not preferable.

In addition to the unmodified polyester, which is obtained by the above polycondensation reaction, a urea-modified polyester is also preferable and included in the polyester. For obtaining the urea-modified polyester, a carboxyl group or a hydroxyl group at the end of the polyester, which is obtained by the polycondensation reaction, is allowed to react with a polyisocyanate compound (PIC) to get a polyester prepolymer (A) that has an isocyanate group. The polyester prepolymer (A) is allowed to react with amines and during the reaction, a molecular chain is subjected to the crosslinking reaction and/or the elongation reaction to obtain the urea-modified polyester.

Examples of the polyisocyanate compounds (PIC) include aliphatic polyisocyanates (tetramethylene diisocyanate, hexamethylene diisocyanate, 2,6-isocyanatomethyl caproate, etc.), alicyclic polyisocyanates (isophorone diisocyanate, cyclohexyl methane diisocyanate, etc.), aromatic diisocyanates (tolylene diisocyanate, diphenyl methane diisocyanate, etc.), aromatic aliphatic diisocyanates (α,α,α',α'-tetramethyl xylylene diisocyanate, etc.), isocyanates, compounds that are obtained by blocking the above polyisocyanates using phenol derivatives, oximes, caprolactam, etc., and combinations of two or more types thereof.

A ratio of the polyisocyanate compounds (PIC), which is expressed as an equivalent ratio (NCO)/(OH) of an isocyanate group (NCO) to a hydroxyl group (OH) of the polyester that has a hydroxyl group, is normally 5/1 to 1/1, preferably 4/1 to 1.2/1, and further preferably 2.5/1 to 1.5/1. If the ratio of (NCO)/(OH) exceeds 5, the low temperature fixability of the toner deteriorates. If a molar ratio of (NCO) is less than 1/1, when using the urea-modified polyester, an urea content in the polyester decreases and the anti-offset ability of the toner deteriorates.

The content of the polyisocyanate compound (PIC) component in the polyester prepolymer (A) that has an isocyanate group is normally 0.5% to 40% by weight, preferably 1% to 30% by weight, and further preferably 2% to 20%. If the content of the polyisocyanate compound (PIC) component is less than 0.5% by weight, the anti-offset ability of the toner deteriorates and maintaining a balance between heat resistant storability and the low temperature fixability of the toner becomes difficult. Further, if the content of the polyisocyanate compound (PIC) component exceeds 40% by weight, the low temperature fixability of the toner deteriorates.

The number of isocyanate groups contained in the polyester prepolymer (A) per molecule is normally greater than or equal to 1, preferably 1.5 to 3, and further preferably 1.8 to 2.5. If the number of isocyanate groups per molecule is less than 1, a molecular weight of the urea-modified polyester decreases and the anti-offset ability of the toner deteriorates.

Next, examples of the amines (B) which are allowed to react with the polyester prepolymer (A) include diamine compounds (B1), triamines or higher polyamine compounds (B2), amino alcohols (B3), amino mercaptans (B4), amino acids (B5), and compounds (B6) in which amino groups of B1 to B5 are blocked.

Examples of the diamine compounds (B1) include aromatic diamines (phenylene diamine, diethyl toluene diamine, 4,4'-diamine diphenyl methane, etc.), alicyclic diamines (4,4'-diamino-3,3'-dimethyl.dicyclohexyl methane, diamine cyclohexane, isophorone diamine, etc.), and aliphatic diamines (ethylene diamine, tetramethylene diamine, hexamethylene diamine, etc.). Examples of the triamines or higher polyamine compounds (B2) include diethylene triamine and triethylene tetramine. Examples of the amino alcohols (B3) include ethanolamine and hydroxyethyl aniline. Examples of the amino mercaptans (B4) include aminoethyl mercaptan and aminopropyl mercaptan. Examples of the amino acids (B5) include aminopropionic acid and aminocaproic acid. Examples of the compounds (B6) in which the amino groups of B1 to B5 are blocked include ketimine compounds and oxazolidine compounds, which are obtained from the above amines B1 to B5 and ketones (acetone, methyl ethyl ketone, methyl isobutyl ketone, etc.). Among the amines (B), the diamine compounds of B1 and mixtures of B1 and a small amount of B2 are preferable.

A ratio of the amines (B), which is expressed as an equivalent ratio (NCO)/(NHx) of an isocyanate group (NCO) from the polyester prepolymer (A) that has the isocyanate group to an amino group (NHx) from the amines (B), is normally 1/2 to 2/1, preferably 1.5/1 to 1/1.5, and further preferably 1.2/1 to 1/1.2. If the ratio (NCO)/(NHx) becomes greater than 2 or less than ½, the molecular weight of the urea-modified polyester is reduced and the anti-offset ability of the toner deteriorates.

The urea-modified polyester may also have urethane bonds along with urea bonds. A molar ratio of a content of the urea bonds and a content of the urethane bonds is normally 100/0 to 10/90, preferably 80/20 to 20/80, and further preferably 60/40 to 30/70. If the molar ratio of the urea bonds is less than 10%, the anti-offset ability of the toner deteriorates.

The urea-modified polyester is manufactured using a one-shot method, etc. The polyhydric alcohols (PO) and the polycarboxylic acids (PC) are heated to 150° C. to 280° C. in the presence of a commonly known esterification catalyst such as tetrabutoxy titanate, dibutyltin oxide, etc. Pressure is reduced if necessary and water generated during the reaction is distilled to obtain the polyester that has a hydroxyl group. Next, the polyester is allowed to react with polyisocyanate (PIC) at 40° C. to 140° C. to get the polyester prepolymer (A) that has an isocyanate group. Next, the polyester prepolymer (A) is allowed to react with the amines (B) at 0° C. to 140° C. to obtain the urea-modified polyester.

When allowing the polyester to react with (PIC) and when allowing (A) to react with (B), a solvent may also be used if necessary. Examples of the solvents that may be used include aromatic solvents (toluene, xylene, etc.), ketones (acetone, methyl isobutyl ketone, etc.), esters (ethyl acetate, etc.), amides (dimethyl formamide, dimethyl acetoamide, etc.), and ethers (tetrahydrofuran, etc.) that are inactive with respect to the isocyanates (PIC).

Further, during the crosslinking reaction and/or the elongation reaction between the polyester prepolymer (A) and the amines (B), a reaction terminator may also be used if necessary and the molecular weight of the obtained urea-modified polyester may be regulated. Examples of the reaction terminator are monoamines (diethylamine, dibutylamine, butylamine, laurylamine, etc.) and compounds (ketimine compounds) in which the monoamines are blocked.

The weight average molecular weight of the urea-modified polyester is normally greater than or equal to 10,000, preferably 20,000 to 100,000,000, and further preferably 30,000 to 1,000,000. If the weight average molecular weight of the urea-modified polyester is less than 10,000, the anti-offset ability of the toner deteriorates. When using the unmodified polyester, a number average molecular weight of the urea-modified polyester is not especially limited, and any number average molecular weight that is easily converted into the weight average molecular weight may be used. When using the urea-modified polyester by itself, the number average molecular weight of the urea-modified polyester is normally 2,000 to 15,000, preferably 2,000 to 10,000, and further preferably 2,000 to 8,000. The number average molecular weight of the urea-modified polyester exceeding 20,000 results in deterioration of the low temperature fixability and the gloss of the toner when the toner is used in a full color image-forming apparatus.

Using a combination of the unmodified polyester and the urea-modified polyester enables to enhance the low temperature fixability of the toner and the gloss when the toner is used in a full color image-forming apparatus 100. Thus, using a combination of the unmodified polyester and the urea-modified polyester is preferable than using the urea-modified polyester by itself. Further, the unmodified polyester may also include a polyester that is modified using other chemical bonds than the urea bonds.

At least a portion of the unmodified polyester and the urea-modified polyester being mutually compatible is preferable for the low temperature fixability and the anti-offset ability. Thus, a similar composition of the unmodified polyester and the urea-modified polyester is preferable.

A weight ratio of the unmodified polyester to the urea-modified polyester is normally 20/80 to 95/5, preferably 70/30 to 95/5, further preferably 75/25 to 95/5, and especially preferably 80/20 to 93/7. If the weight ratio of the urea-modified polyester is less than 5%, the anti-offset ability of the toner deteriorates and maintaining a balance between heat resistant storability and the low temperature fixability of the toner becomes difficult.

A glass transition point (Tg) of a binder resin that includes the unmodified polyester and the urea-modified polyester is normally 45° C. to 65° C., and preferably 45° C. to 60° C. If the glass transition point is less than 45° C., a heat resistance of the toner deteriorates. If the glass transition point exceeds 65° C., the low temperature fixability of the toner becomes insufficient.

Because the urea-modified polyester is likely to remain on the surface of the obtained parent toner particles, regardless of the low glass transition point, heat resistant storability of the toner is favorable compared to a commonly known polyester-based toner.

Herein, as the colorant, the charge control agent, the release agent, the external additive, etc., the materials described above may be used.

Next, a method of manufacturing the toner is explained. Although the manufacturing method explained below is preferable, the present invention is not limited thereto.

Method of Manufacturing Toner

1) The coloring agent, the unmodified polyester, the polyester prepolymer that has an isocyanate group, and the mold releasing agent are dispersed in the organic solvent to form a toner material solution.

A volatile organic solvent having a boiling point of less than 100° C. is preferable for easy removal of the organic solvent after formation of the parent toner particles. To be specific, toluene, xylene, benzene, tetrachlorocarbon, chloromethylene, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. may be used alone or as a combination of two or more thereof. Especially, aromatic solvents such as toluene and xylene, and halogenated hydrocarbons such as chloromethylene, 1,2-dichloroethane, chloroform and tetrachlorocarbon are preferable. A usage amount of the organic solvent is normally 0 to 300 parts by weight, preferably 0 to 100 parts by weight, and further preferably 25 to 70 parts by weight with respect to 100 parts by weight of the polyester prepolymer.

2) The toner material solution is emulsified in an aqueous solvent in the presence of a surfactant and resin particles.

The aqueous solvent may be water alone or may include organic solvents such as alcohols (methanol, isopropyl alcohol, ethylene glycol, etc.), dimethyl formamide, tetrahydrofuran, cellosolves (methyl cellosolve, etc.), and lower ketones (acetone, methyl ethyl ketone, etc.).

A usage amount of the aqueous solvent is normally 50 to 2,000 parts by weight, and preferably 100 to 1,000 parts by weight of the aqueous solvent with respect to 100 parts by weight of the toner material solution. If the usage amount of the aqueous solvent becomes less than 50 parts by weight, the dispersed state of the toner material solution deteriorates and toner particles of a predetermined particle diameter cannot be obtained. If the usage amount of the aqueous solvent exceeds 20,000 parts by weight, toner manufacturing is not economical.

Further, a dispersing agent such as a surfactant or resin particles is suitably added for enhancing dispersion in the aqueous solvent.

Examples of the surfactant include anionic surfactants such as alkylbenzene sulfonate, α-olefin sulfonate and ester phosphate; cationic surfactants of amine salt type such as alkylamine salts, amino alcohol fatty acid derivatives, polyamine fatty acid derivatives and imidazoline; cationic surfactants of quaternary ammonium salt type such as alkyl trimethyl ammonium salt, dialkyldimethyl ammonium salt, alkyldimethylbenzyl ammonium salt, pyridinium salt, alkyl isoquinolium salt and chlorobenzetonium; nonionic surfactants such as fatty acid amide derivatives and polyhydric alcohol derivatives; and zwitterionic surfactants such as alanine, dodecyldi(aminoethyl) glycine, di(octylaminoethyl) glycine and N-alkyl-N,N-dimethyl ammonium betaine.

Using the surfactant that has a fluoroalkyl group enables to enhance the effect of the surfactant with an extremely small amount of the surfactant. Examples of preferably used anionic surfactants that have a fluoroalkyl group include fluoroalkyl carboxylic acids having 2 to 10 carbon atoms and metal salts thereof, perfluorooctane sulfonyl disodium glutamate, 3-[ω-fluoroalkyl(C6 to C11)oxy]-1-alkyl(C3 to C4)sodium sulfonate, 3-[ω-fluoroalkanoyl(C6 to C8)-N-ethylamino]-1-propane sodium sulfonate, fluoroalkyl (C11 to C20)carboxylic acid and metal salts thereof, perfluoroalkyl carboxylic acid(C7 to C13) and metal salts thereof, perfluoroalkyl(C4 to C12)sulfonic acid and metal salts thereof, perfluorooctane sulfonic acid diethanol amide, N-propyl-N-(2-hydroxyethyl)perfluorooctane sulfonamide, perfluoroalkyl (C6 to C10)sulfonamide propyltrimethyl ammonium salt, perfluoroalkyl(C6 to C10)-N-ethylsulfonyl glycine salt, monoperfluoroalkyl(C6 to C16)ethyl phosphoric acid ester, etc.

Examples of product names thereof include Surflon S-111, S-112, and S-113 (manufactured by Asahi Glass Co.), Fluorad FC-93, FC-95, FC-98, and FC-129 (manufactured by Sumitomo 3M Ltd.), Unidyne DS-101 and DS-102 (manufactured by Daikin Industries Ltd.), Megaface F-110, F-120, F-113, F-191, F-812, and F-833 (manufactured by Dainippon Ink and Chemicals, Inc.), ECTOP EF-102, 103, 104, 105, 112, 123A, 123B, 306A, 501, 201, and 204 (manufactured by Tohkem Products Co.), Futargent F-100 and F-150 (manufactured by Neos Co.), etc.

Examples of the cationic surfactant include primary or secondary aliphatic amines that have a fluoroalkyl group, aliphatic quaternary ammonium salts such as perfluoroalkyl (C6 to C10)sulfonamide propyltrimethyl ammonium salt, benzalkonium salt, benzetonium chloride, pyridinium salt, and imidazolium salt. Examples of product names thereof include Surflon S-121 (manufactured by Asahi Glass Co.), Fluorad FC-135 (manufactured by Sumitomo 3M Ltd.), Unidyne DS-202 (manufactured by Daikin Industries Ltd.), Megaface F-150 and F-824 (manufactured by Dainippon Ink and Chemicals, Inc.), ECTOP EF-132 (manufactured by Tohkem Products Co.), and Futargent F-300 (manufactured by Neos Co.), etc.

The resin particles are added for stabilizing the parent toner particles that are formed in the aqueous solvent. To stabilize the parent toner particles, the resin particles are preferably added such that a surface coverage of the resin particles on the surface of the parent toner particles is in a range of 10 to 90%. Examples of the resin particles include methyl polymethacrylate particles of 1 μm and 3 μm, polystyrene particles of 0.5 μm and 2 μm, poly(styrene-acrylonitrile) particles of 1 μm, etc. Examples of product names thereof include PB-200H (manufactured by Kao Corp.), SGP (manufactured by Soken Co.), Technopolymer-SB (manufactured by Sekisui Plastics Co.), SGP-3G (manufactured by Soken Co.), Micropearl (manufactured by Sekisui Fine Chemicals Co.), etc. Further, dispersing agents of inorganic compounds such as tricalcium phosphate, calcium carbonate, titanium oxide, colloidal silica, hydroxyapatite, etc. may also be used.

By using a polymeric protecting colloid, dispersion droplets of the above resin particles may also be stabilized as a dispersing agent that may be used in combination with the inorganic compound dispersing agent. Examples of the polymeric protecting colloids that may be used include acids such as acrylic acid, methacrylic acid, α-cyanoacrylic acid, α-cyanomethacrylic acid, itaconic acid, crotonic acid, fumaric acid, maleic acid and maleic anhydride; methacrylic monomers that have a hydroxyl group, for example, acrylic acid-β-hydroxyethyl, methacrylic acid-β-hydroxyethyl, acrylic acid-β-hydroxypropyl, methacrylic acid-p-hydroxypropyl, acrylic acid-y-hydroxypropyl, methacrylic acid-y-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin monomethacrylic acid ester, N-methylol acrylic amide, N-methylol methacrylic amide, etc.; vinyl alcohol or ethers with vinyl alcohol, for example, vinyl methyl ether, vinyl ethyl ether, vinyl propyl ether, etc.; esters of a vinyl alcohol and a compound having a carboxyl group, for example, vinyl acetate, vinyl propionate, vinyl butyrate, etc.; acrylic amide, methacrylic amide, diacetone acrylic amide or methylol compounds thereof; acid chlorides such as acryloyl chloride and methacroyl chloride, nitrogen-containing compounds such as vinyl pyridine, vinyl pyrrolidone, vinyl imidazole and ethylene imine; or heterocyclic homopolymers or copolymers thereof; polyoxyethylenes such as polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester and polyoxyethylene nonylphenyl ester; and celluloses such as methyl cellulose, hydroxyethyl cellulose, hydroxypropyl cellulose, etc.

The dispersion method is not particularly limited, and commonly known methods such as a low-speed shearing method, a high-speed shearing method, a friction method, a high-pressure jet method and an ultrasonic method may be applied. Among them, the high speed shearing method is preferable for ensuring a particle diameter of 2 to 20 μm of the dispersion body. When using the dispersion device of a high-speed shearing method, the revolution number is not particularly limited, but is normally 1,000 to 30,000 revolutions per minute (rpm), and preferably 5,000 to 20,000 rpm. The dispersion time is not particularly limited, but is normally 0.1 to 5 minutes when a batch method is used. The dispersion temperature is normally 0 to 150° C. (under pressure), and preferably 40 to 98° C.

3) Along with preparation of an emulsified liquid, amines (B) are simultaneously added and the emulsified liquid is allowed to react with a polyester prepolymer (A) that has an isocyanate group.

During this reaction, the molecular chain is subjected to the crosslinking reaction and/or the elongation reaction. The reaction time is selected based on a reactivity of an isocyanate group structure contained in the polyester prepolymer (A) with the amines (B), but is normally 10 minutes to 40 hours, and preferably 2 to 24 hours. The reaction temperature is normally 0 to 150° C. and preferably 40 to 98° C. A commonly known catalyst may be used if necessary. To be specific, a catalyst such as dibutyltin laurate or dioctyltin laurate may be used.

4) After completion of the reaction, the organic solvent is removed from the emulsification-dispersion body (reaction product) and the reaction product is cleaned and dried to obtain the parent toner particles.

For removing the organic solvent, the temperature is gradually increased while stirring a laminar flow of the entire reaction product. After strongly stirring the reaction product at a fixed temperature range, the organic solvent is removed to prepare spindle-shaped parent toner particles. Further, if a chemical such as a calcium phosphate, which is soluble in acid and alkali, is used as a dispersion stabilizer, the calcium phosphate is dissolved using an acid such as hydrochloric acid and the resulting solution is washed with water to remove the calcium phosphate from the toner particles. Further, the calcium phosphate may also be removed using a procedure such as enzymatic breakdown.

5) A charge control agent is added to the obtained parent toner particles and inorganic fine particles, such as silica fine particles or titanium oxide fine particles, are then externally added to obtain toner.

When an external additive and a lubricant are added to prepare a developer, the external additive and the lubricant may be added and mixed individually or simultaneously. A general powder mixer is used to mix, for example, the external additive. However, preferably, for example, a jacket may be provided to adjust the internal temperature. Examples of the mixer that can be used include a V-mixer, a rocking mixer, a rocking mixer, a Lodige mixer, a Nauta mixer, and a Henschel mixer. It is preferable to add the external additives while changing the mixing conditions, such as a rotational speed, a tumbling speed, time, and temperature, to prevent the formation of a lubricant thin film on the surface of the toner. In this way, it is possible to easily obtain toner with a small particle size and a sharp particle size distribution. The shape of the toner can be controlled between a spherical shape and a spindle shape by applying strong stirring force in the process of removing the organic solvent. In addition, it is possible to control the morphology of the surface between a smooth surface and a wrinkly surface.

The toner according to the embodiment of the invention may be mixed with magnetic carriers and used as a two-component developer. In this case, it is preferable that the density of the toner in the developer including the toner and the carrier be 1 part by weight to 10 parts by weight with respect to 100 parts by weight of carrier. The toner according to the embodiment of the invention may be a non-magnetic toner or a one-component magnetic toner without using a carrier.

An operation of forming a full color image in the above-mentioned structure will be described below.

In the image forming operation of the image forming apparatus 1 according to the embodiment of the invention, first, the exposure device 4 emits a laser beam to the photosensitive element 3 charged with a negative polarity to form each color electrostatic latent image on the surface of the photosensitive element 3. Then, reversal development in which the developing device 40 develops the electrostatic latent image into a toner image with a predetermined color toner having the same polarity (negative polarity) as the charging polarity of the photosensitive element 3 is performed. In this case, an endless intermediate transfer belt 51 is supported by a plurality of rollers 531 to 534 and is provided above the photosensitive elements 3Y, 3C, 3M, and 3K. In addition, the intermediate transfer belt 51 extends so as to contact a portion of each of the photosensitive elements 3Y, 3C, 3M, and 3K after a development process and is rotated in the direction of the arrow. The toner images formed by the photosensitive elements 3Y, 3C, 3M, and 3K are transferred to the intermediate transfer belt 51 by the primary transfer rollers 52Y, 52C, 52M, and 52K and are superposed on each other to form a non-fixed image. The belt cleaning device 55 is provided at a position facing the roller 534 in an outer circumferential portion of the intermediate transfer belt 51. The belt cleaning device 55 removes unnecessary toner remaining on the surface of the intermediate transfer belt 51 or a foreign material, such as paper powder. Members related to the intermediate transfer belt 51 are integrated into the transfer device 50 and the transfer device 50 is removably provided in the image forming apparatus 1.

The secondary transfer roller 54 is provided in the vicinity of the supporting roller 532 in the outer circumference of the intermediate transfer belt 51. When a bias is applied to the secondary transfer roller 54 while the recording member 9 passes between the intermediate transfer belt 51 and the secondary transfer roller 54, the toner image on the intermediate transfer belt 51 is transferred to the recording member 9. A transfer current applied to the secondary transfer roller 54 has a positive polarity opposite to the polarity of the toner.

The feeding device 60 including a feed cassette 61 in which the recording members 9 are stored so as to be fed is provided at a lower part of the image forming apparatus 1. Only one recording member 9 is reliably transported from the feed cassette 61 to a registration roller 63 by a transport roller 62. The recording member 9 passing through the transfer roller 54 is transported to the fixing device 70 provided on the downstream side in the transport direction. For example, the fixing device 70 including a heating unit may be a type in which a heater is provided in a roller, a belt fixing device that rotates a heated belt, or a fixing device using induction heating as a heating method. The fixing device 70 is controlled by a control unit (not shown) such that appropriate fixing conditions are set depending on the kind of images, such as a full color image or a monochrome image, and a printing mode, such as single-side printing or double-side printing.

After fixation, the recording member 9 is discharged to the discharge tray 91 provided in the image forming apparatus 1 by the discharge roller 93 and is then stacked thereon.

In the image forming apparatus according to the embodiment of the invention, it is possible to prevent the deterioration of a lubricant applying performance due to the abrasion of the lubricant smoothing blade, appropriately maintain the lubricant applying performance of the lubricant smoothing blade for a long time, and prevent the formation of a color streak image and an image with uneven density.

In addition, it is possible to prevent a foreign material from being caught and the occurrence of an error due to the foreign material, reduce the abrasion of the lubricant smoothing blade abrasion, improve the durability of the cleaning device including the cleaning blade, and increase the life span of the entire image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which a latent image is formed;

a charging device that charges the image carrier;

an exposure device that illuminates the image carrier to form the latent image on the image carrier;

a developing device that develops the latent image to form a toner image on the image carrier;

a transfer device that transfers the toner image onto the recording medium via an intermediate transfer body;

a cleaning device that removes toner remaining on the image carrier after the toner image is transferred; and a lubricant applying device that applies a lubricant to the image carrier, wherein the lubricant applying devices includes:

a solid lubricant, a lubricant supply roller that applies the lubricant to the image carrier by coming into contact with the solid lubricant and the image carrier, and a lubricant smoothing blade having a first surface, the first surface configured to come into contact with the image carrier to smooth the lubricant applied on the image carrier, the first surface and the image carrier being substantially parallel when the first surface comes into contact with the image carrier;

the first surface comes into contact with the image carrier in a trailing direction, and the lubricant smoothing blade is arranged such that a distal end thereof that does not contact the image carrier is oriented toward a center of the image carrier.

2. The image forming apparatus according to claim 1, wherein the lubricant applying device is downstream of the cleaning member in a direction in which the image carrier rotates.

3. The image forming apparatus according to claim 1, wherein after the image carrier is stopped, the image carrier is rotated in a direction opposite to an image forming direction.

4. The image forming apparatus according to claim 1, wherein after the image carrier is stopped, constantly or under a predetermined condition, a surface of the image carrier is moved in a direction opposite to an image forming direction, and a movement distance of the surface of the image carrier in the opposite direction is equal to or more than a shortest distance between a contact point between the lubricant supply roller and the surface of the image carrier and a contact point between the lubricant smoothing blade and the surface of the image carrier.

5. The image forming apparatus according to claim 4, wherein the movement distance of the surface of the image carrier in the opposite direction is equal to or more than a longest distance between the contact point between the lubricant supply roller and the surface of the image carrier and the contact point between the lubricant smoothing blade and the surface of the image carrier.

6. The image forming apparatus according to claim 4, wherein the charging device includes a charging roller, the developing device includes a developing roller, and the movement distance of the surface of the image carrier in the opposite direction is equal to or less than a shortest distance between a contact point between the developing roller and the surface of the image carrier and a contact point between the charging roller and the surface of the image carrier.

7. The image forming apparatus according to claim 6, wherein the charging roller is a contact charging roller.

8. The image forming apparatus according to claim 6, wherein the charging roller faces the image carrier with a small gap therebetween.

9. The image forming apparatus according to claim 6, wherein a voltage in which an AC voltage is superimposed on a DC voltage is applied to the charging roller.

10. The image forming apparatus according to claim 1, wherein the movement distance of the surface of the image carrier in the opposite direction is equal to or more than a longest distance between the contact point between the lubricant supply roller and the surface of the image carrier and the contact point between the lubricant smoothing blade and the surface of the image carrier.

11. The image forming apparatus according to claim 1, wherein the charging device includes a charging roller, the developing device includes a developing roller, and the movement distance of the surface of the image carrier in the opposite direction is equal to or less than a shortest distance between a contact point between the developing roller and the surface of the image carrier and a contact point between the charging roller and the surface of the image carrier.

12. The image forming apparatus according to claim 11, wherein the charging roller is a contact charging roller.

13. The image forming apparatus according to claim 11, wherein a voltage in which an AC voltage is superimposed on a DC voltage is applied to the charging roller.

14. The image forming apparatus according to claim 1, wherein the lubricant includes both a fatty acid metal salt (A) and an inorganic lubricant (B).

15. The image forming apparatus according to claim 14, wherein the fatty acid metal salt (A) is zinc stearate, and the inorganic lubricant (B) is boron nitride.

16. The image forming apparatus according to claim 1, further comprising:

a process cartridge that includes the image carrier and the lubricant applying device.

17. A process cartridge comprising:

an image carrier on which a latent image is formed;

a charging device that charges the image carrier;

a developing device that develops the latent image to form a toner image on the image carrier;

a cleaning device that removes toner remaining on the image carrier after the toner image is transferred onto a recording medium; and a lubricant applying device that applies a lubricant to the image carrier, wherein the lubricant applying devices includes:

a solid lubricant, a lubricant supply roller that applies the lubricant to the image carrier by coming into contact with the solid lubricant and the image carrier, and a lubricant smoothing blade having a first surface, the first surface configured to come into contact with the image carrier to smooth the lubricant applied on the image carrier, the first surface and the image carrier being substantially parallel when the first surface comes into contact with the image carrier;

the first surface comes into contact with the image carrier in a trailing direction, and the lubricant smoothing blade is arranged such that a distal end thereof that does not contact the image carrier is oriented toward a center of the image carrier.

18. A lubricant applying device comprising:

a solid lubricant;

a lubricant supply roller that applies lubricant to an image carrier by coming into contact with the solid lubricant and the image carrier; and a lubricant smoothing blade having a first surface, the first surface configured to come into contact with the image carrier to smooth the lubricant applied on the image carrier, the first surface and the image carrier being substantially parallel when the first surface comes into contact with the image carrier, wherein the first surface comes into contact with the image carrier in a trailing direction, and the lubricant smoothing blade is arranged such that a distal end thereof that does not contact the image carrier is oriented toward a center of the image carrier.

* * * * *